US009311881B2

(12) United States Patent
Iwamoto et al.

(10) Patent No.: US 9,311,881 B2
(45) Date of Patent: Apr. 12, 2016

(54) LIQUID CRYSTAL DISPLAY DEVICE AND DRIVE METHOD FOR SAME

(75) Inventors: Akihisa Iwamoto, Osaka (JP); Hideki Morii, Osaka (JP); Takayuki Mizunaga, Osaka (JP); Kazuya Nakaminami, Osaka (JP); Satoshi Horiuchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 157 days.

(21) Appl. No.: 14/364,090

(22) PCT Filed: Aug. 9, 2012

(86) PCT No.: PCT/JP2012/070341

§ 371 (c)(1),
(2), (4) Date: Jun. 10, 2014

(87) PCT Pub. No.: WO2013/088779

PCT Pub. Date: Jun. 20, 2013

(65) Prior Publication Data

US 2014/0306948 A1 Oct. 16, 2014

(30) Foreign Application Priority Data

Dec. 15, 2011 (JP) ..... 2011-274283

(51) Int. Cl.
*G09G 3/36* (2006.01)

(52) U.S. Cl.
CPC ..... *G09G 3/3677* (2013.01); *G09G 3/3648* (2013.01); *G09G 3/3696* (2013.01); *G09G 2310/0286* (2013.01); *G09G 2330/02* (2013.01); *G09G 2330/027* (2013.01)

(58) Field of Classification Search
CPC ..... G09G 3/3677; G09G 3/3648
USPC ..... 345/213, 100, 99
See application file for complete search history.

(56) References Cited

U.S. PATENT DOCUMENTS 8,559,588 B2 * 10/2013 Kikuchi ..... G11C 19/28 377/64
2001/0009411 A1 * 7/2001 Kusanagi ..... G09G 3/3648 345/93
2005/0008114 A1 * 1/2005 Moon ..... G09G 3/3677 377/64

(Continued)

FOREIGN PATENT DOCUMENTS

WO 2010/050262 A1 5/2010
WO 2011/055584 A1 5/2011

OTHER PUBLICATIONS

Official Communication issued in International Patent Application No. PCT/JP2012/070341, mailed on Nov. 13, 2013

*Primary Examiner* — Temesgh Ghebretinsae
*Assistant Examiner* — Benyam Ketema
(74) *Attorney, Agent, or Firm* — Keating & Bennett, LLP

(57) ABSTRACT

Provided are: a liquid crystal display device capable of rapidly removing residual electric charges in a panel when a power supply is turned off, and in particular, suitable for a case where IGZO-GDM is adopted; and a driving method of the liquid crystal display device.

In the liquid crystal display device, when an OFF state of the power supply is detected, a power supply OFF sequence including an initialization step, a first discharge step and a second discharge step is executed. In the initialization step, only a clear signal (H_CLR) among GDM signals is set at a high level, and a state of each of bistable circuits which constitute a shift register is initialized. In the first discharge step, only the clear signal (H_CLR) among the GDM signals is set at a low level, all of gate bus lines are turned to a selected state, and electric charges in pixel formation portions are discharged. In the second discharge step, the clear signal (H_CLR) is set at the high level, and electric charges on floating nodes in each of the bistable circuits are discharged.

20 Claims, 13 Drawing Sheets

(56) References Cited

U.S. PATENT DOCUMENTS

2010/0182305 A1* 7/2010 Fang ..... G09G 3/3677 345/212
2011/0134090 A1* 6/2011 Iwamoto ..... G09G 3/3677 345/206
2012/0218245 A1* 8/2012 Morii ..... G09G 3/3677 345/211

* cited by examiner

Fig.12

| | USUAL OPERATION (~t0) | INITIALIZATION STEP (t1~t2) | FIRST DISCHARGE STEP (t2~t3) | SECOND DISCHARGE STEP (t3~t4) |
|---|---|---|---|---|
| H_GSP | VGH1, VGL | VGL | VGH1 | VGH1 (GND) |
| H_GCK | VGH1, VGL | VGL | VGH1 | VGH1 (GND) |
| H_CLR | VGH2, VGL | VGH2 | VGL | VGH2 |
| H_VSS | VGL | VGL | VGH1 | VGH1 (GND) |

LIQUID CRYSTAL DISPLAY DEVICE AND DRIVE METHOD FOR SAME

TECHNICAL FIELD

The present invention relates to a liquid crystal display device and a driving method thereof, and particularly, relates to a liquid crystal display device suitable for a case of adopting a monolithic gate driver having a thin film transistor that uses an oxide semiconductor (IGZO) for a semiconductor layer, and to a driving method thereof.

BACKGROUND ART

In general, an active matrix-type liquid crystal display device includes a liquid crystal panel made of two substrates which sandwich a liquid crystal layer therebetween. On one substrate of the two substrates, a plurality of gate bus lines (scanning signal lines) and a plurality of source bus lines (video signal lines) are arranged in a grid pattern, and a plurality of pixel formation portions are arranged in a matrix so as to correspond to the respective intersections of the plurality of gate bus lines and the plurality of source bus lines. Each of the pixel formation portions includes: a thin film transistor (TFT) that is a switching element having a gate terminal connected to a gate bus line passing through its corresponding intersection and a source terminal connected to a source bus line passing through the intersection; a pixel capacitance for holding a pixel value; and the like. Moreover, on other substrate of the above-described two substrates, in some case, a common electrode that is a counter electrode provided commonly to the plurality of pixel formation portions is provided. The active matrix-type liquid crystal display device is also provided with a gate driver (scanning signal line drive circuit) that drives the plurality of gate bus lines, and a source driver (video signal line drive circuit) that drives the plurality of source bus lines.

Video signals, each of which indicates the pixel value, are transmitted by the source bus lines; however, each of the source bus lines cannot transmit video signals indicating pixel values for a plurality of rows at a time (simultaneously). Therefore, writing of the video signals to the pixel capacitances in the above-mentioned pixel formation portions arranged in the matrix is sequentially performed row by row. Accordingly, the gate driver is constituted by a shift register including a plurality of stages such that the plurality of gate bus lines can be sequentially selected every predetermined period.

In the liquid crystal display device as described above, in some case, although a power supply is turned off by a user, display is not cleared immediately, and an image like an afterimage remains. A reason for this is because, when the power supply of the device is turned off, a discharge path of electric charges held in each of the pixel capacitances is shut off, and residual electric charges are accumulated in each of the pixel formation portions. Moreover, when the power supply of the device is turned on in a state where the residual electric charges are accumulated in each of the pixel formation portions, there occurs deterioration in display quality, such as an occurrence of a flicker caused by a bias of impurities, the bias being based on the residual electric charges. Accordingly, in such an event where the power supply is turned off, for example, all of the gate bus lines are turned to a selected state (ON state), and a black voltage is applied to the source bus lines, whereby the electric charges on the panel are discharged.

Moreover, with regard to the liquid crystal display device, in recent years, a gate driver that is made monolithic is progressed. Heretofore, it has been frequent that the gate driver is mounted as an IC (Integrated Circuit) chip on a peripheral portion of the substrate that constitutes the liquid crystal panel; however, in recent years, the gate driver has gradually come to be directly formed on the substrate. The gate driver as described above is called a "monolithic gate driver" and the like. Moreover, a panel including the monolithic gate driver is called a "gate driver monolithic panel" and the like.

In the gate driver monolithic panel, the above-mentioned method cannot be adopted with regard to the discharge of the electric charges on the panel. Accordingly, in WO 2011/055584, an invention of the liquid crystal display device, which is as described below, is disclosed. In a bistable circuit that constitutes the shift register in the gate driver, a TFT is provided, which includes: a drain terminal connected to a gate bus line; a source terminal connected to a reference potential wire that transmits a reference potential; and a gate terminal that is given a clock signal that operates the shift register. In such a configuration, when the supply of the power supply from the outside is shut off, the clock signal is turned to a high level to turn the above-described TFT to an ON state, and in addition, a level of the reference potential is raised from a gate OFF potential to a gate ON potential. In such a way, a potential of each of the gate bus lines is raised to the gate ON potential, and the residual electric charges in all of the pixel formation portions are discharged. Moreover, in WO 2010/050262, a technology for preventing a malfunction caused by leakage in the TFT is disclosed as an invention relating to the gate driver monolithic panel.

PRIOR ART DOCUMENTS

Patent Documents

[Patent Document 1] WO 2011/055584
[Patent Document 2] WO 2010/050262

SUMMARY OF THE INVENTION

Problems to be Solved by the Invention

Incidentally, in recent years, there has been advanced development of an IGZO-TFT liquid crystal panel (liquid crystal panel using IGZO (indium gallium zinc oxide) that is a type of oxide semiconductors for a semiconductor layer of a thin film transistor). Also in the IGZO-TFT liquid crystal panel, development of a monolithic gate driver is being progressed. Note that, hereinafter, a monolithic gate driver provided on the IGZO-TFT liquid crystal panel is referred to as "IGZO-GDM". OFF characteristics of an a-Si TFT are not good, and therefore, in an a-Si TFT liquid crystal panel, floating electric charges in portions other than the pixel formation portions are discharged in a few seconds. Hence, in the a-Si TFT liquid crystal panel, the floating electric charges in the portions other than the pixel formation portion are not particularly regarded as a problem. However, the IGZO-TFT is excellent not only in ON characteristics but also in OFF characteristics. In particular, OFF characteristics when a bias voltage to the gate is 0V (that is, when a bias is none) are remarkably excellent in comparison with those of the a-Si TFT, and therefore, floating electric charges at a node connected to the TFT are not discharged through the TFT at a gate OFF time. As a result, the electric charges remain in the circuit for a long time. In accordance with a certain trial calculation, in an IGZO-GDM that adopts a configuration as shown in FIG. 10 to be described later, a time required to discharge floating electric charges on netA is several hours (several thousand seconds to several ten thousand seconds). Moreover, in accordance with a BT (Bias Temperature) stress test of the IGZO-GDM, a magnitude of a threshold value shift of the IGZO-TFT is several voltages per hour. From this, it is grasped that, in the IGZO-GDM, the presence of the residual electric charges becomes a large factor of the threshold value shift of the IGZO-TFT. From the above, when a shift operation stops in the middle in the shift register of the IGZO-GDM, there is a risk that a threshold value shift of the TFT occurs in only a certain stage. As a result, the shift register comes not to operate normally, and image display on a screen is not performed.

Moreover, in a case where the gate driver is an IC chip, the TFT in the panel is only a TFT in the pixel formation portion. Hence, in an event where the power supply is off, it is sufficient to discharge the electric charges in each of the pixel formation portions and the electric charges on each of the gate bus lines. However, in a case of the monolithic gate driver, as the TFT in the panel, the TFT is also present in the gate driver. Then, in the configuration shown in FIG. 10, for example, two floating nodes denoted by reference character netA and reference character netB are present. Hence, in the IGZO-GDM, in the event where the power supply is off, it is necessary to discharge the electric discharges in the pixel formation portion, the electric charges on the gate bus line, the electric charges on netA, and the electric charges on netB.

Accordingly, it is an object of the present invention to provide a liquid crystal display device capable of rapidly removing the residual electric charges in the panel when the power supply is turned off, and in particular, suitable for the case where the IGZO-GDM is adopted, and to provide a driving method of the liquid crystal display device.

Means for Solving the Problems

A first aspect of the present invention is directed to a liquid crystal display device comprising:

a substrate that constitutes a display panel;

a plurality of video signal lines which transmit video signals;

a plurality of scanning signal lines which intersect the plurality of video signal lines;

a plurality of pixel formation portions arranged in a matrix so as to correspond to the plurality of video signal lines and the plurality of scanning signal lines;

a scanning signal line drive circuit that includes a shift register made of a plurality of bistable circuits which are provided so as to correspond to the plurality of scanning signal lines and sequentially output pulses based on a clock signal, and that selectively drives the plurality of scanning signal lines based on the pulses outputted from the shift register;

a power supply circuit that generates, based on a power supply given from an outside, a scanning signal line selection potential as a potential for turning the scanning signal lines to a selected state, and a scanning signal line non-selection potential as a potential for turning the scanning signal lines to a non-selected state;

a drive control unit that generates the clock signal, a clear signal for initializing states of the plurality of bistable circuits, and a reference potential as a potential serving as a reference of operations of the plurality of bistable circuits, and controls an operation of the scanning signal line drive circuit; and a power supply state detection unit that gives a predetermined power supply OFF signal to the drive control unit upon detecting an OFF state of the power supply, wherein the plurality of video signal lines, the plurality of scanning signal lines, the plurality of pixel formation portions, and the scanning signal line drive circuit are formed on the substrate, each of the bistable circuits includes:

an output node connected to the scanning signal line;

an output control switching element in which a second electrode is given the clock signal, and a third electrode is connected to the output node;

a first node connected to a first electrode of the output control switching element; and a first first-node control switching element in which a first electrode is given the clear signal, a second electrode is connected to the first node, and a third electrode is given the reference potential, the power supply circuit generates, as the scanning signal line selection potential, a first scanning signal line selection potential and a second scanning signal line selection potential, which are different from each other in change state of a potential level when the power supply is turned to an OFF state, the drive control unit:

sets a potential of the clock signal at the first scanning signal line selection potential or the scanning signal line non-selection potential;

sets a potential of the clear signal at the second scanning signal line selection potential or the scanning signal line non-selection potential;

sets the reference potential at the first scanning signal line selection potential or the scanning signal line non-selection potential; and upon receiving the power supply OFF signal, sequentially performs first discharge processing for setting the potential of the clock signal and the reference potential at the first scanning signal line selection potential, and second discharge processing for setting the potential of the clear signal at the second scanning signal line selection potential, and at a point of time when the second discharge processing is started, the first scanning signal line selection potential is equalized to a ground potential, and the second scanning signal line selection potential is maintained at a potential level at which the switching elements included in each of the bistable circuits are turned to an ON state.

According to a second aspect of the present invention, in the first aspect of the present invention, each of the bistable circuits further includes:

a second first-node control switching element in which a second electrode is connected to the first node, and a third electrode is given the reference potential;

a second node connected to a first electrode of the second first-node control switching element; and a second-node control switching element in which a first electrode is given the clear signal, a second electrode is connected to the second node, and a third electrode is given the reference potential.

According to a third aspect of the present invention, in the first aspect of the present invention, when the power supply is turned to the OFF state, the first scanning signal line selection potential is changed gradually with a constant gradient from a potential at a point of time when the power supply is turned to the OFF state to the ground potential.

According to a fourth aspect of the present invention, in the third aspect of the present invention, the power supply circuit includes a first scanning signal line selection potential generation line for generating the first scanning signal line selection potential based on a predetermined potential generated by the power supply, and a second scanning signal line selection potential generation line for generating the second scanning signal line selection potential based on the predetermined potential, the first scanning signal line selection potential generation line being connected to a first capacitor and a first resistor, the second scanning signal line selection potential generation line being connected to a second capacitor and a second resistor, and a discharge time constant determined by the second capacitor and the second resistor is larger than a discharge time constant determined by the first capacitor and the first resistor.

According to a fifth aspect of the present invention, in the first aspect of the present invention, the drive control unit sets the potential of the clear signal at the scanning signal line non-selection potential in an event of the first discharge processing.

According to a sixth aspect of the present invention, in the first aspect of the present invention, when the drive control unit receives the power supply OFF signal, the drive control unit performs initialization processing for setting the potential of the clear signal at the second scanning signal line selection potential and setting the reference potential at the scanning signal line non-selection potential, before the first discharge processing.

According to a seventh aspect of the present invention, in the sixth aspect of the present invention, the drive control unit sets the potential of the clock signal at the scanning signal line non-selection potential in an event of the initialization processing.

According to an eighth aspect of the present invention, in the first aspect of the present invention, each of the bistable circuits further includes an output-node control switching element, in which a first electrode is given the clock signal, a second electrode is connected to the output node, and a third electrode is given the reference potential.

According to a ninth aspect of the present invention, in any one of the first to eighth aspect of the present invention, the switching elements included in each of the bistable circuits are thin film transistors made of an oxide semiconductor.

According to a tenth aspect of the present invention, in the ninth aspect of the present invention, the oxide semiconductor is indium gallium zinc oxide (IGZO).

An eleventh aspect of the present invention is directed to a driving method of a liquid crystal display device including: a substrate that constitutes a display panel; a plurality of video signal lines which transmit video signals; a plurality of scanning signal lines which intersect the plurality of video signal lines; a plurality of pixel formation portions arranged in a matrix so as to correspond to the plurality of video signal lines and the plurality of scanning signal lines; a scanning signal line drive circuit that drives the plurality of scanning signal lines; a power supply circuit that generates, based on a power supply given from an outside, a scanning signal line selection potential as a potential for turning the scanning signal lines to a selected state, and a scanning signal line non-selection potential as a potential for turning the scanning signal lines to a non-selected state; and a drive control unit that controls an operation of the scanning signal line drive circuit, the driving method comprising:

a power supply state detection step of detecting ON/OFF states of the power supply given from the outside; and an electric charge discharging step of discharging electric changes in the display panel, the electric charge discharging step being executed when the OFF state of the power supply is detected in the power supply state detection step, wherein the scanning signal line drive circuit includes a shift register made of a plurality of bistable circuits which are provided so as to correspond to the plurality of scanning signal lines and sequentially output pulses based on a clock signal, the drive control unit generates the clock signal, a clear signal for initializing states of the plurality of bistable circuits, and a reference potential as a potential serving as a reference of operations of the plurality of bistable circuits, each of the bistable circuits includes:

an output node connected to the scanning signal line;

an output-control switching element in which a second electrode is given the clock signal, and a third electrode is connected to the output node;

a first node connected to a first electrode of the output-control switching element; and a first first-node control switching element in which a first electrode is given the clear signal, a second electrode is connected to the first node, and a third electrode is given the reference potential, the power supply circuit generates, as the scanning signal line selection potential, a first scanning signal line selection potential and a second scanning signal line selection potential, which are different from each other in change state of a potential level when the power supply is turned to the OFF state, the electric charge discharging step includes:

a first discharge step of setting the potential of the clock signal and the reference potential at the first scanning signal line selection potential; and a second discharge step of setting the potential of the clear signal at the second scanning signal line selection potential, and at a point of time when the second discharge step is started, the first scanning signal line selection potential is equalized to a ground potential, and the second scanning signal line selection potential is maintained at a potential level at which the switching elements included in each of the bistable circuits are turned to an ON state.

According to a twelfth aspect of the present invention, in the eleventh aspect of the present invention, each of the bistable circuits further includes:

a second first-node control switching element in which a second electrode is connected to the first node, and a third electrode is given the reference potential;

a second node connected to a first electrode of the second first-node control switching element; and a second-node control switching element in which a first electrode is given the clear signal, a second electrode is connected to the second node, and a third electrode is given the reference potential.

According to a thirteenth aspect of the present invention, in the eleventh aspect of the present invention, when the power supply is turned to the OFF state, the first scanning signal line selection potential is changed gradually with a constant gradient from a potential at a point of time when the power supply is turned to the OFF state to the ground potential.

According to a fourteenth aspect of the present invention, in the thirteenth aspect of the present invention, the power supply circuit includes a first scanning signal line selection potential generation line for generating the first scanning signal line selection potential based on a predetermined potential generated by the power supply, and a second scanning signal line selection potential generation line for generating the second scanning signal line selection potential based on the predetermined potential, the first scanning signal line selection potential generation line being connected to a first capacitor and a first resistor, the second scanning signal line selection potential generation line being connected to a second capacitor and a second resistor, and a discharge time constant determined by the second capacitor and the second resistor is larger than a discharge time constant determined by the first capacitor and the first resistor.

According to a fifteenth aspect of the present invention, in the eleventh aspect of the present invention, the potential of the clear signal is set at the scanning signal line non-selection potential in the first discharge step.

According to a sixteenth aspect of the present invention, in the eleventh aspect of the present invention, the electric charge discharging step further includes, as a step performed before the first discharge step, an initialization step of setting the potential of the clear signal at the second scanning signal line selection potential and setting the reference potential at the scanning signal line non-selection potential.

According to a seventeenth aspect of the present invention, in the sixteenth aspect of the present invention, the potential of the clock signal is set at the scanning signal line non-selection potential in the initialization step.

According to an eighteenth aspect of the present invention, in the eleventh aspect of the present invention, each of the bistable circuits further includes an output-node control switching element in which a first electrode is given the clock signal, a second electrode is connected to the output node, and a third electrode is given the reference potential.

According to a nineteenth aspect of the present invention, in any one of the eleventh to eighteenth aspect of the present invention, the switching elements included in each of the bistable circuits are thin film transistors made of an oxide semiconductor.

According to a twentieth aspect of the present invention, in the nineteenth aspect of the present invention, the oxide semiconductor is indium gallium zinc oxide (IGZO).

Effects of the Invention

According to a first aspect of the present invention, when the supply of the power supply is shut off in the liquid crystal display device, two processings (first discharge processing and second discharge processing) for discharging the electric charges in the display panel are sequentially performed. In the first discharge processing, the potential of the clock signal and the reference potential are set at the first scanning signal line selection potential. Thus, the potential of the clock signal turned to the high level is given to the output node through the output control switching element, and accordingly, each of the scanning signal lines is turned to the selected state. At this time, by setting the video signal potential at the ground potential, the electric charges in the respective pixel formation portions are discharged. Moreover, the first scanning signal line selection potential is lowered to the ground potential before the second discharge processing is started. Therefore, in the event of the first discharge processing, the potential of the clock signal and the reference potential are gradually lowered, and the electric charges on the scanning signal lines are also discharged. In the second discharge processing, the potential of the clear signal is set at the second scanning signal line selection potential. At the point of time when the second discharge processing is started, the second scanning signal line selection potential is maintained at the potential level at which the switching elements included in each of the bistable circuits are turned to the ON state, and accordingly, the electric charges on the floating nodes (first node and second node) in each of the bistable circuits are discharged by the second discharge processing. In such a way as described above, the residual electric charges in the display panel are rapidly removed when the power supply is turned off, and an occurrence of display defect/malfunction that may be caused by the presence of the residual electric charges in the display panel is suppressed.

According to a second aspect of the present invention, it is made possible to draw the potential of the first node into the reference potential during the usual operation according to needs, and the occurrence of the malfunction is suppressed.

According to a third aspect of the present invention, the potential of the output node is gradually lowered in the event of the first discharge processing. Therefore, with regard to the potential of each of the pixels, potential variations owing to a kick-back voltage can be reduced to a level free from problems.

According to a fourth aspect of the present invention, it is made possible to generate two types of the scanning signal line selection potentials, which are different from each other in the change state of the potential level in the event where the supply of the power supply is shut off, by a relatively simple configuration. Moreover, the discharge of the electric charges on the scanning signal lines in the event of the first discharge processing and the discharge of the electric charges on the floating nodes (first node and second node) in the bistable circuits in the event of the second discharge processing are performed more surely.

According to a fifth aspect of the present invention, the discharge of the electric charges on the scanning signal lines is performed more surely in the event of the first discharge processing.

According to a sixth aspect of the present invention, each of the bistable circuits in the shift register is initialized before the first discharge processing is performed. Therefore, the residual electric charges in the display panel are removed more surely when the power supply is turned off, and the occurrence of the display defect/malfunction that may be caused by the presence of the residual electric charges in the display panel is effectively suppressed.

According to a seventh aspect of the present invention, each of the bistable circuits in the shift register is initialized more surely in the event of the initialization processing.

According to an eighth aspect of the present invention, in the event of the first discharge processing, the output-node control switching element is turned to the ON state in a state where the reference potential is turned to the high level. Therefore, in the event of the first discharge processing, each of the scanning signal lines can be surely turned to the selected state, and the electric charges in the respective pixel formation portions can be discharged.

According to a ninth aspect of the present invention, a similar effect to that of the first aspect of the present invention is obtained in the liquid crystal display device including the display panel using the oxide semiconductor for the semiconductor layers of the thin film transistors. Heretofore, in such a liquid crystal display device, the malfunction that may be caused by the presence of the residual electric charges in the circuit is prone to occur. Accordingly, an effect of suppressing the occurrence of the display defect/malfunction that may be caused by the presence of the residual electric charges in the display panel is obtained to a larger extent.

According to a tenth aspect of the present invention, a similar effect to that of the first aspect of the present invention is obtained in the liquid crystal display device including the IGZO-GDM. Heretofore, in the liquid crystal display device including the IGZO-GDM, the malfunction that may be caused by the presence of the residual electric charges in the circuit is prone to occur. Accordingly, the effect of suppressing the occurrence of the display defect/malfunction that may be caused by the presence of the residual electric charges in the display panel is obtained to a larger extent.

According to an eleventh aspect of the present invention, such a similar effect to that of the first aspect of the present invention can be exerted in the driving method of the liquid crystal display device.

According to a twelfth aspect of the present invention, such a similar effect to that of the second aspect of the present invention can be exerted in the driving method of the liquid crystal display device.

According to a thirteenth aspect of the present invention, such a similar effect to that of the third aspect of the present invention can be exerted in the driving method of the liquid crystal display device.

According to a fourteenth aspect of the present invention, such a similar effect to that of the fourth aspect of the present invention can be exerted in the driving method of the liquid crystal display device.

According to a fifteenth aspect of the present invention, such a similar effect to that of the fifth aspect of the present invention can be exerted in the driving method of the liquid crystal display device.

According to a sixteenth aspect of the present invention, such a similar effect to that of the sixth aspect of the present invention can be exerted in the driving method of the liquid crystal display device.

According to a seventeenth aspect of the present invention, such a similar effect to that of the seventh aspect of the present invention can be exerted in the driving method of the liquid crystal display device.

According to an eighteenth aspect of the present invention, such a similar effect to that of the eighth aspect of the present invention can be exerted in the driving method of the liquid crystal display device.

According to a nineteenth aspect of the present invention, such a similar effect to that of the ninth aspect of the present invention can be exerted in the driving method of the liquid crystal display device.

According to a twentieth aspect of the present invention, such a similar effect to that of the tenth aspect of the present invention can be exerted in the driving method of the liquid crystal display device.

BRIEF DESCRIPTION OF THE DRAWINGS

FIG. 12 is a table for explaining potentials taken by the respective signals at a time of a usual operation and the time of the power supply shut-off in the embodiment.

MODE FOR CARRYING OUT THE INVENTION

A description is made below of an embodiment of the present invention with reference to the accompanying drawings. Note that, in the following description, a gate terminal (gate electrode) of each of thin film transistors corresponds to a first electrode, a drain terminal (drain electrode) thereof corresponds to a second electrode, and a source terminal (source electrode) thereof corresponds to a third electrode. Moreover, the description is made on the assumption that all of thin film transistors provided in bistable circuits are of the n-channel type.

1. Entire Configuration and Operation

Figure 2:
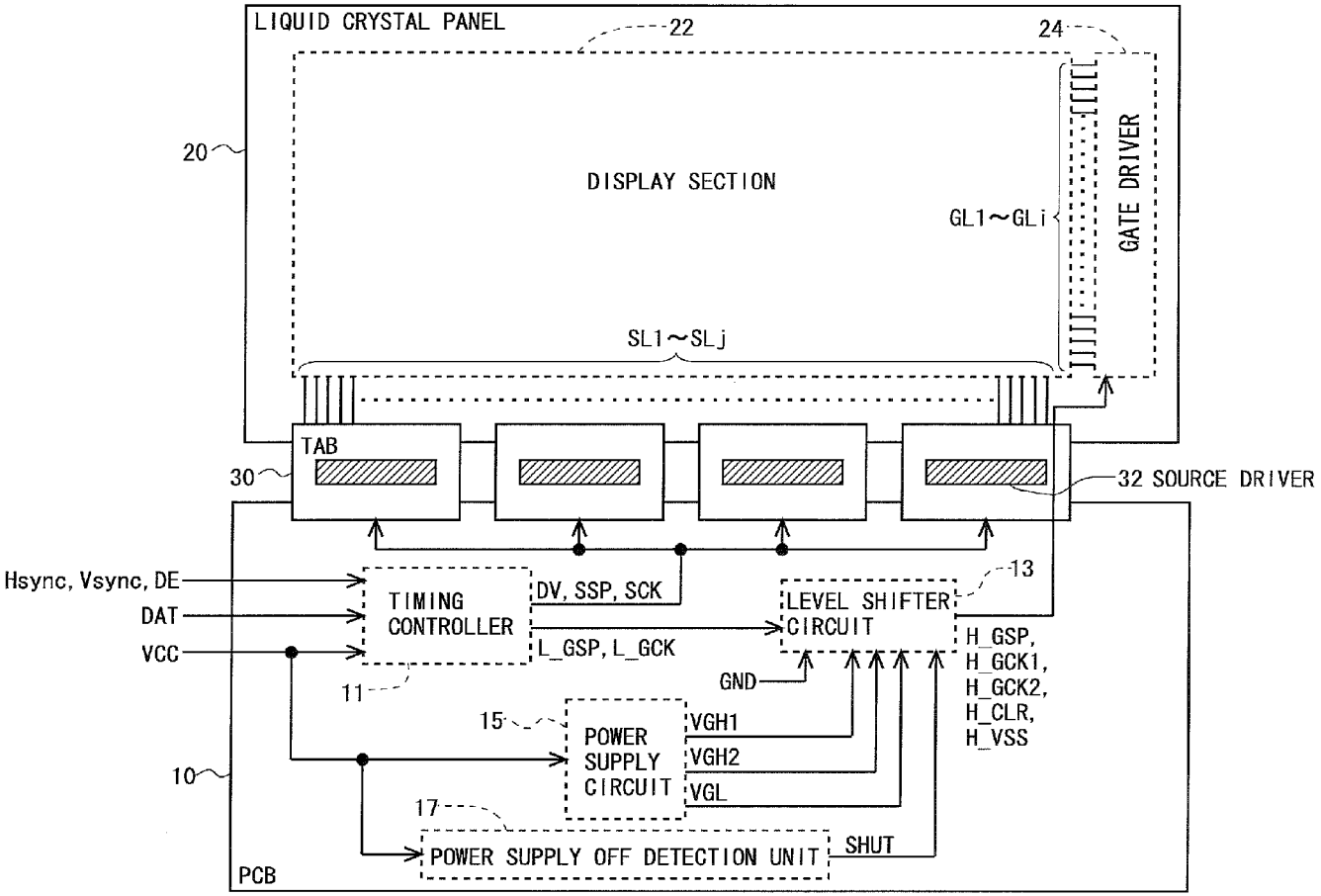
FIG. 2 is a block diagram showing an entire configuration of the liquid crystal display device in the embodiment.

FIG. 2 is a block diagram showing an entire configuration of an active matrix-type liquid crystal display device according to an embodiment of the present invention. As shown in FIG. 2, this liquid crystal display device is constituted by: a liquid crystal panel (display panel) 20; a PCB (printed circuit board) 10; and a TAB (Tape Automated Bonding) 30 connected to the liquid crystal panel 20 and the PCB 10. Note that the liquid crystal panel 20 is an IGZO-TFT liquid crystal panel. Moreover, the TAB 30 has amounting form adopted mainly in a middle to large-size liquid crystal panel, and in some case, a COG mounting is also adopted as a mounting form of a source driver in a small to middle-size liquid crystal panel. Furthermore, nowadays, a system driver configuration, in which a source driver 32, a timing controller 11, a power supply circuit 15, a power supply OFF detection unit 17, and a level shifter circuit 13 are packaged into one chip, is also being gradually adopted.

This liquid crystal display device operates upon receiving supply of a power supply from an outside. When the power supply is normally supplied to this liquid crystal display device, for example, a potential of +5V is given to this liquid crystal display device. Hereinafter, the potential given from the power supply to this liquid crystal display device is referred to as an "input power supply potential". Note that, when the supply of the power supply is shut off, the input power supply potential is gradually lowered to the ground potential (0V).

Figure 3:
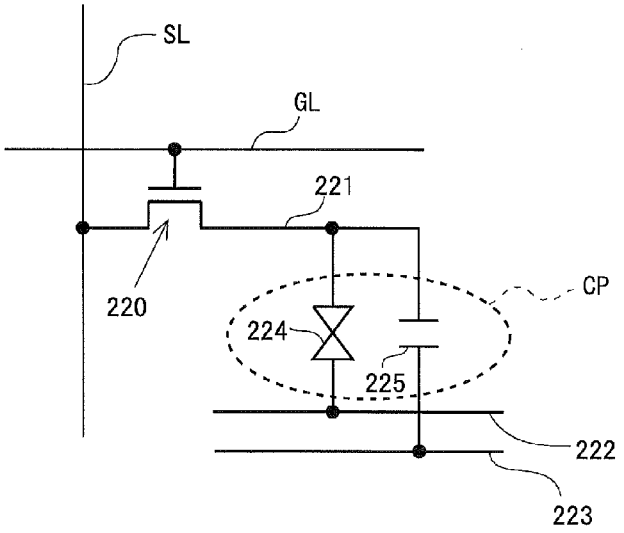
FIG. 3 is a circuit diagram showing a configuration of a pixel formation portion in the embodiment.

The liquid crystal panel 20 is formed of two opposite substrates (which are typically glass substrates; however, are not limited to the glass substrates), and a display section 22 for displaying an image is formed in a predetermined region on the substrates. The display section 22 includes: a plurality (j) of source bus lines (video signal lines) SL1 to SLj; a plurality (i) of gate bus lines (scanning signal lines) GL1 to GLi; and a plurality (i×j) of pixel formation portions provided so as to correspond to the respective intersections of the source bus lines SL1 to SLj and the gate bus lines GL1 to GLi. FIG. 3 is a circuit diagram showing a configuration of each of the pixel formation portions. As shown in FIG. 3, each pixel formation portion includes: a thin film transistor (TFT) 220 having a gate terminal connected to the gate bus line GL passing through its corresponding intersection and a source terminal connected to the source bus line SL passing through the intersection; a pixel electrode 221 connected to a drain terminal of the thin film transistor 220; a common electrode 222 and an auxiliary capacitance electrode 223, which are commonly provided for the plurality of pixel formation portions; a liquid crystal capacitance 224 formed of the pixel electrode 221 and the common electrode 222; and an auxiliary capacitance 225 formed of the pixel electrode 221 and the auxiliary capacitance electrode 223. Moreover, a pixel capacitance CP is formed of the liquid crystal capacitance 224 and the auxiliary capacitance 225. Then, based on a video signal which the source terminal of the thin film transistor 220 receives from the source bus line SL when the gate terminal of the thin film transistor 220 receives an active scanning signal from the gate bus line GL, a voltage indicating a pixel value is held in the pixel capacitance CP. Note that, with regard to the thin film transistor in the pixel formation portion, an IGZO-TFT (a thin film transistor using IGZO (indium gallium zinc oxide) that is a type of oxide semiconductors for a semiconductor layer) may be adopted, or other TFT (a-Si TFT or the like) may be used.

Moreover, as shown in FIG. 2, in the liquid crystal panel 20, a gate driver 24 for driving the gate bus lines GL1 to GLi is formed. This gate driver 24 is the above-mentioned IGZO-GDM, and is monolithically formed on the substrate that constitutes the liquid crystal panel 20. On the TAB 30, the source driver 32 for driving the source bus lines SL1 to SLj is mounted in a state of an IC chip. On the PCB 10, the timing controller 11, the level shifter circuit 13, the power supply circuit 15, and the power supply OFF detection unit 17 are provided. Note that, in FIG. 2, the gate driver 24 is arranged only on one side of the display section 22; however, such gate drivers 24 are sometimes arranged on both right and left sides of the display section 22.

As described above, in this embodiment, the plurality (j) of source bus lines SL1 to SLj; the plurality (i) of gate bus lines (scanning signal lines) GL1 to GLi; and the plurality (i×j) of pixel formation portions and the gate driver 24 are formed on one substrate that constitutes the liquid crystal panel 20.

From the outside, this liquid crystal display device is given: timing signals such as a horizontal synchronization signal Hsync, a vertical synchronization signal Vsync, and a data enable signal DE; an image signal DAT; and an input power supply potential VCC. The input power supply potential VCC is given to the timing controller 11, the power supply circuit 15, and the power supply OFF detection unit 17. The input power supply potential VCC during a usual operation is set, for example, at +5V; however, this input power supply potential VCC is not limited to +5V. Moreover, input signals are not limited to the above-described configuration. In some case, the timing signals and the video data are transferred by using a differential interface such as an LVDS, mipi, a DP signal, and an eDP.

Based on the input power supply potential VCC, the power supply circuit 15 generates agate ON potential (scanning signal line selection potential) VGH, which is maintained at a potential level at which the gate bus lines are turned to a selected state at the time of the usual operation, and a gate OFF potential (scanning signal line non-selection potential) VGL, which is maintained at a potential level at which the gate bus lines are turned to a non-selected state at the time of the usual operation. Note that, with regard to the gate ON potential and the gate OFF potential, which are generated in this power supply circuit 15, the potential levels thereof are maintained to be constant at the time of the usual operation; however, when the supply of the power supply from the outside is shut off, the potential levels are changed. In this embodiment, the power supply circuit 15 generates two types of potentials (first gate ON potential VGH1 and second gate ON potential VGH2) as the gate ON potential VGH. A description will be made later in detail of a configuration for generating the two types of gate ON potentials. Note that the gate ON potential VGH at the time of the usual operation is set, for example, at +20V, and the gate OFF potential VGL at the time of the usual operation is set, for example, at −10V. The first gate ON potential VGH1, the second gate ON potential VGH2 and the gate OFF potential VGL, which are generated in the power supply circuit 15, are given to the level shifter circuit 13. The power supply OFF detection unit 17 outputs a power supply state signal SHUT indicating a supply state of the power supply (ON/OFF state of the power supply). The power supply state signal SHUT is given to the level shifter circuit 13. Note that, in this embodiment, a power supply OFF signal is realized by the power supply state signal SHUT turned to a high level.

The timing controller 11 receives the timing signals such as the horizontal synchronization signal Hsync, the vertical synchronization signal Vsync and the data enable signal DE, the image signal DAT and the input power supply potential VCC, and generates a digital video signal DV, a source start pulse signal SSP, a source clock signal SCK, a gate start pulse signal L_GSP, and a gate clock signal L_GCK. The digital video signal DV, the source start pulse signal SSP and the source clock signal SCK are given to the source driver 32, and the gate start pulse signal L_GSP and the gate clock signal L_GCK are given to the level shifter circuit 13. Note that, with regard to the gate start pulse signal L_GSP and the gate clock signal L_GCK, high-level-side potentials thereof are set at the input power supply potential VCC, and low-level-side potentials thereof are set at the ground potential GND (0V).

By using the ground potential GND, and the first gate ON potential VGH1, the second gate ON potential VGH2 and the gate OFF potential VGL, which are given from the power supply circuit 15, the level shifter circuit 13 performs: generation of a signal H_GSP after level conversion of a signal obtained by converting the gate start pulse signal L_GSP, which is outputted from the timing controller 11, into a timing signal optimized for such an IGZO-GDM drive; generation of a first gate clock signal H_GCK1 and a second gate clock signal H_GCK2, which are based on the gate clock signal L_GCK outputted from the timing controller 11; and generation of a reference potential H_VSS and a clear signal H_CLR, which are based on an internal signal. Note that, hereinafter, the first gate clock signal H_GCK1 and the second gate clock signal H_GCK2 are also collectively referred to as a "gate clock signal H_GCK".

Figure 4:
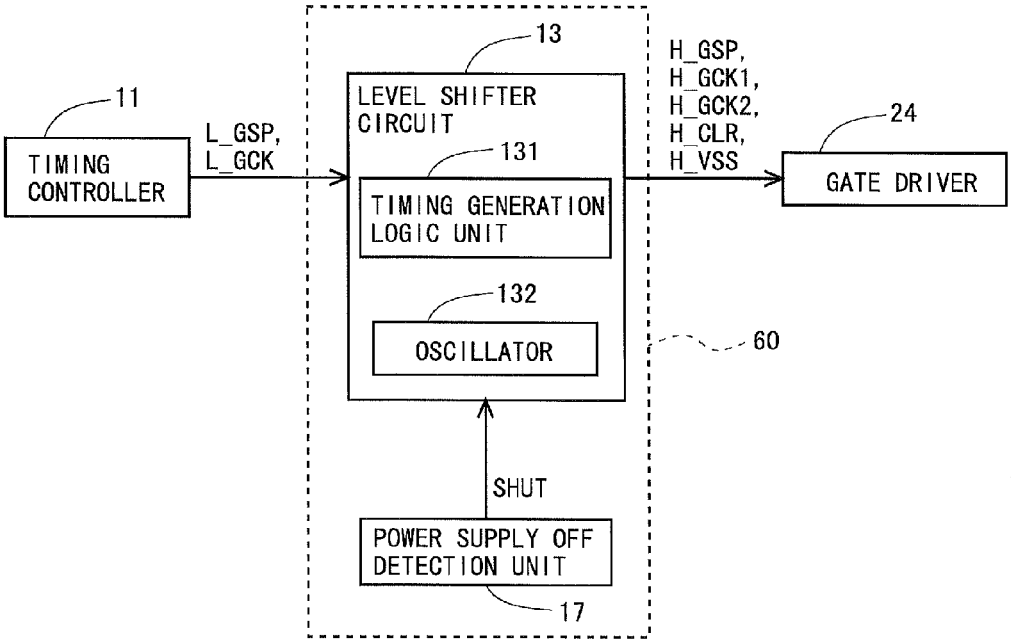
FIG. 4 is a block diagram showing a configuration of a level shifter circuit in the embodiment.

Such a gate start pulse signal H_GSP, the first gate clock signal H_GCK1, the second gate clock signal H_GCK2, the clear signal H_CLR and the reference potential H_VSS, which are generated in the level shifter circuit 13, are given to the gate driver 24. Hereinafter, these signals, which are generated in the level shifter circuit 13 and are given to the gate driver 24, are referred to as "GDM signals" for the sake of convenience. Note that, at the time of the usual operation, potentials of the gate start pulse signal H_GSP, the first gate clock signal H_GCK1 and the second gate clock signal H_GCK2 are set at the first gate ON potential VGH1 or the gate OFF potential VGL, and a potential of the clear signal H_CLR is set at the second gate ON potential VGH2 or the gate OFF potential VGL, and the reference potential H_VSS is set at the gate OFF potential VGL. Incidentally, in this embodiment, as shown in FIG. 4, the level shifter circuit 13 includes a timing generation logic unit 131 and an oscillator 132, and a configuration is adopted such that the power supply state signal SHUT outputted from the power supply OFF detection unit 17 is given to the level shifter circuit 13. With such a configuration, it is made possible for the level shifter circuit 13 to change the potentials of the above-described GDM signals in accordance with pieces of predetermined timing (points of time t1 to t3 in FIG. 1 to be described later). The pieces of predetermined timing are generated, for example, based on a nonvolatile memory in the IC that constitutes the level shifter circuit 13 and a register value obtained by loading data from the nonvolatile memory. Note that a more detailed description of this level shifter circuit 13 will be made later.

The source driver 32 receives the digital video signal DV, the source start pulse signal SSP and the source clock signal SCK, which are outputted from the timing controller 11, and applies driving video signals to the respective source bus lines SL1 to SLj.

Based on the gate start pulse signal H_GSP, the first gate clock signal H_GCK1, the second gate clock signal H_GCK2, the clear signal H_CLR and the reference potential H_VSS, which are outputted from the level shifter circuit 13, the gate driver 24 repeats the application of the active scanning signals to the respective gate bus lines GL1 to GLi in a cycle of one vertical scanning period. Note that a detailed description of this gate driver 24 will be made later.

As described above, the driving video signals are applied to the respective source bus lines SL1 to SLj, and the scanning signals are applied to the respective gate bus lines GL1 to GLi, whereby an image, which is based on the image signal DAT sent from the outside, is displayed on the display section 22.

Note that, in this embodiment, a power supply state detection unit is realized by the power supply OFF detection unit 17, and a drive control unit is realized by the timing controller 11 and the level shifter circuit 13.

2.2 Generation of Two Types of Gate ON Potentials

Figure 5:
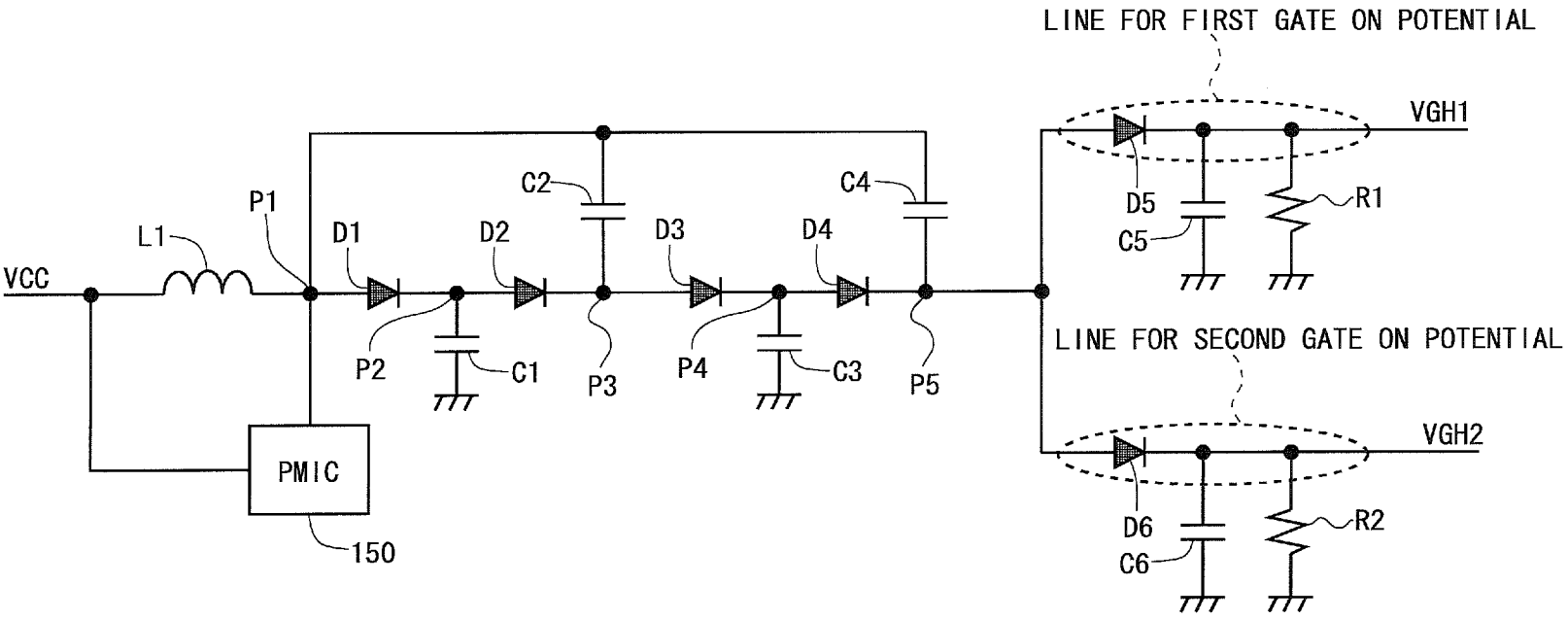
FIG. 5 is a circuit diagram showing an example of a circuit configuration regarding generation of a first gate ON potential and a second gate ON potential in a configuration of a power supply circuit in the embodiment.

Next, with reference to FIG. 5, a description is made of a configuration for generating the above-mentioned two types of the gate ON potentials (first gate ON potential VGH1 and second gate ON potential VGH2). Note that the values of the voltages in this description are merely examples; and the voltages are not limited to those values. FIG. 5 is a circuit diagram showing an example of a circuit configuration regarding the generation of the first gate ON potential VGH1 and the second gate ON potential VGH2 in the configuration of the power supply circuit 15. As shown in FIG. 5, this power supply circuit 15 includes a PMIC (power supply management integrated circuit) 150, one coil L1, six diodes D1 to D6, six capacitors C1 to C6, and two resistors R1 and R2 as constituent elements for generating the two types of the gate ON potentials. Note that a forward voltage drop in each of the diodes D1 to D6 is defined to be "Vf".

In this power supply circuit 15, first, a signal with an amplitude of 5V, which is generated by using the PMIC 150, appears on a nodal point P1. On a nodal point P2, a voltage of (5-Vf)V appears by smoothing using the diode D1 and the capacitor C1. On a nodal point P3, a signal with a voltage of (5-2Vf)V to (10-2Vf)V appears by coupling by the capacitor C2 and by a forward voltage drop in the diode D2. In a similar way, a voltage of (10-3Vf)V appears on a nodal point P4, and a signal with a voltage of (10-4Vf)V to (15-4Vf)V appears on a nodal point P5.

More on an output-side than the nodal point P5, as shown in FIG. 5, a power supply line is branched into a line for the first gate ON potential and a line for the second gate ON potential. In the line for the first gate ON potential, a voltage of (15-5Vf)V is generated by smoothing using the diode D5 and the capacitor C5. In the line for the second gate ON potential, a voltage of (15-5Vf)V is generated by smoothing using the diode D6 and the capacitor C6. In such a way, at the time of the usual operation, the first gate ON potential VGH1 and the second gate ON potential VGH2 are set at an equal potential level.

Figure 6:
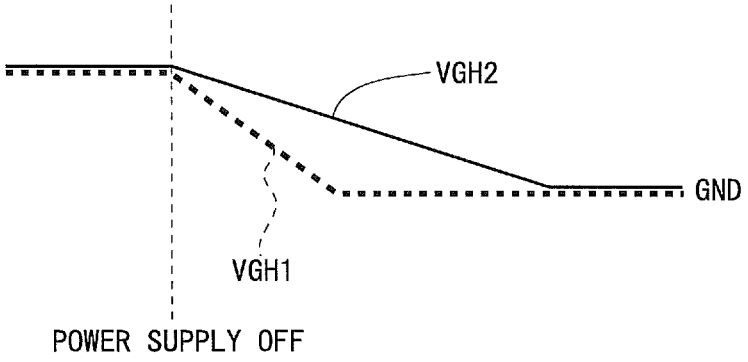
FIG. 6 is a waveform chart showing changes of the first gate ON potential and the second gate ON potential at the time of the power supply shut-off in the embodiment.

Incidentally, when the supply of the power supply is shut off, the potential levels of the first gate ON potential VGH1 and the second gate ON potential VGH2 are lowered in accordance with constants (capacitance values and resistance values) of the capacitors and the resistors, which are connected to the individual lines. In this embodiment, capacitors with different constants and resistors with different constants are connected to the line for the first gate ON potential and the line for the second gate ON potential. More specifically, a discharge time constant in the line for the second gate ON potential, which is determined by the capacitor C6 and the resistor R2, is made larger than a discharge time constant in the line for the first gate ON potential, which is determined by the capacitor C5 and the resistor R1. Hence, when the supply of the power supply is shut off, as shown in FIG. 6, the second gate ON potential VGH2 is lowered more gently than the first gate ON potential VGH1 with regard to the potential level.

3. Configuration and Operation of Gate Driver

Figure 7:
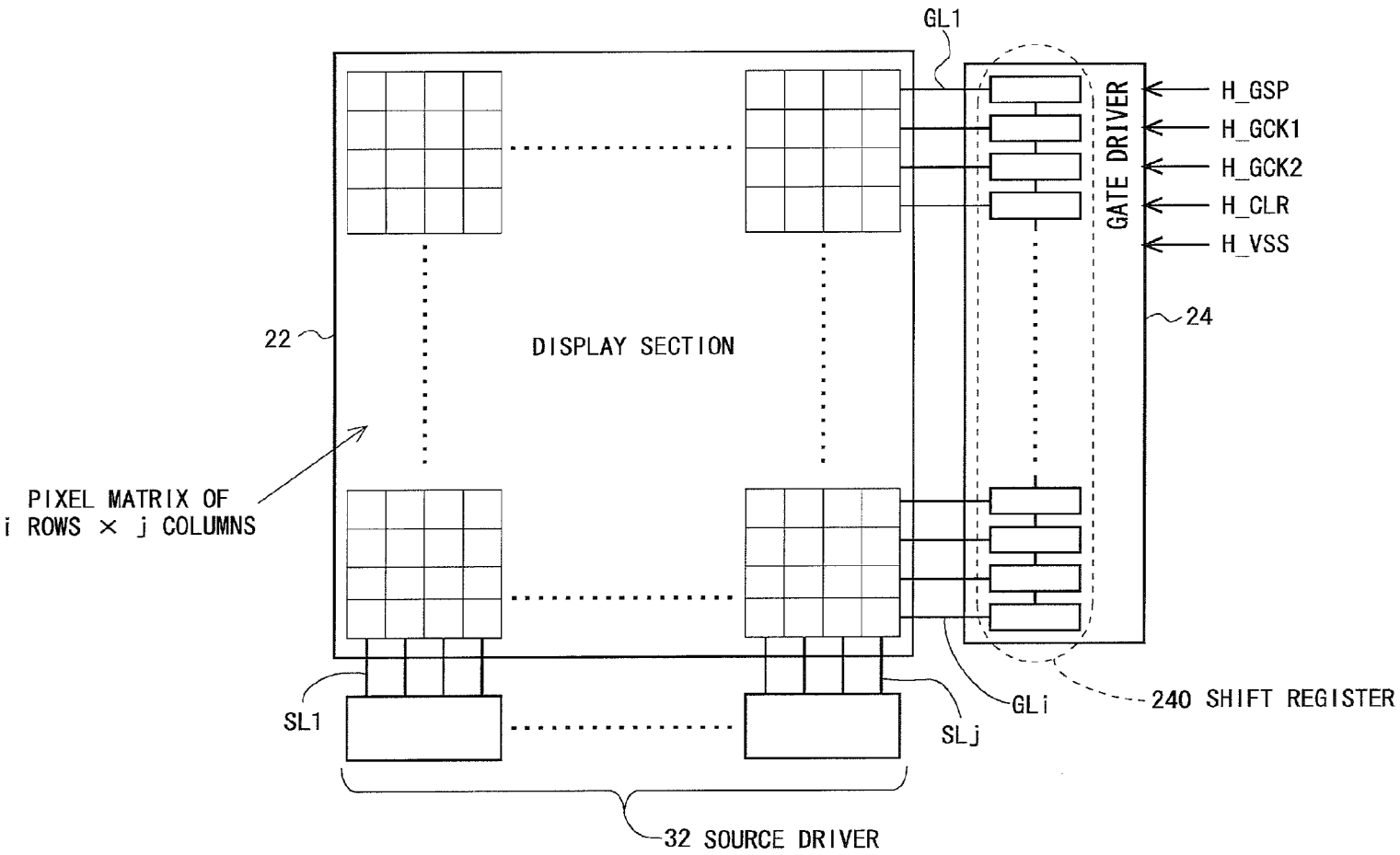
FIG. 7 is a block diagram for explaining a configuration of a gate driver in the embodiment.

Next, a description is made of a configuration and operation of the gate driver 24 in this embodiment. As shown in FIG. 7, the gate driver 24 is constituted by a shift register 240 including a plurality of stages. In the display section 22, a pixel matrix of i rows×j columns is formed. The respective stages of the shift register 240 are provided so as to correspond to the respective rows of the pixel matrix in a one-to-one relationship. Moreover, each stage of the shift register 240 is a bistable circuit that is in either one of two sates at each point of time and outputs a signal (hereinafter, referred to as a "state signal") indicative of the state. Note that the state signal outputted from each stage of the shift register 240 is given as a scanning signal to the gate bus line corresponding thereto.

Figure 8:
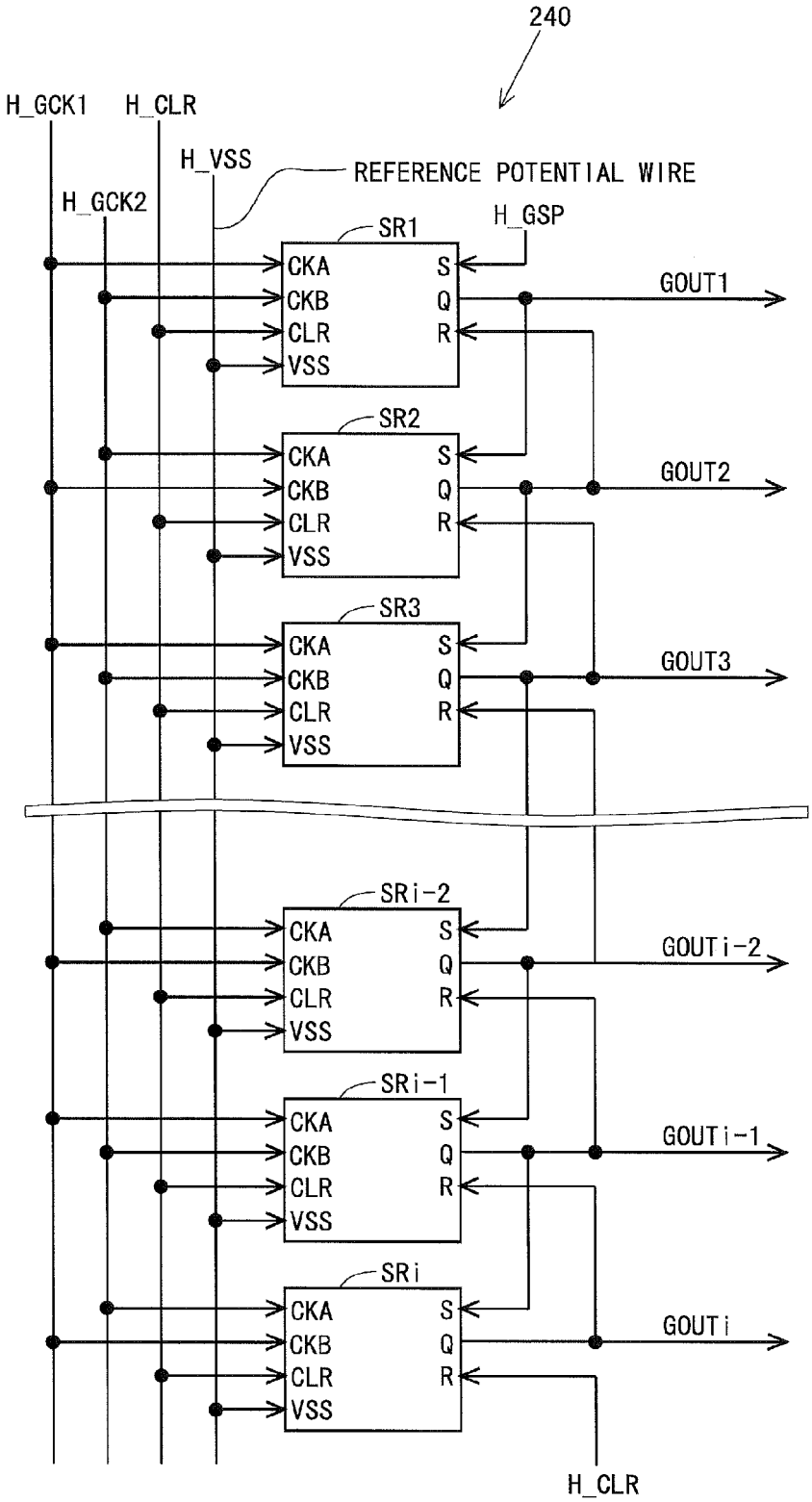
FIG. 8 is a block diagram showing a configuration of a shift register in the gate driver in the embodiment.

FIG. 8 is a block diagram showing a configuration of the shift register 240 in the gate driver 24. In each of the bistable circuits, there are provided: input terminals for receiving a first clock CKA, a second clock CKB, a clear signal CLR, a reference potential VSS, a set signal S and a reset signal R; and an output terminal for outputting a state signal Q. In this embodiment, the reference potential H_VSS outputted from the level shifter circuit 13 is given as the reference potential VSS, and the clear signal H_CLR outputted from the level shifter circuit 13 is given as the clear signal CLR. Moreover, either one of the first gate clock signal H_GCK1 and the second gate clock signal H_GCK2, which are outputted from the level shifter circuit 13, is given as the first clock CKA, and other thereof is given as the second clock CKB. Furthermore, the state signal Q outputted from a preceding stage is given as the set signal S, and the state signal Q outputted from the next stage is given as the reset signal R. That is, when attention is paid to an n-th stage, a scanning signal GOUTn−1 given to an (n−1)-th gate bus line is given as the set signal S, and a scanning signal GOUTn+1 given to an (n+1)-th gate bus line is given as the reset signal R. Note that the gate start pulse signal H_GSP outputted from the level shifter circuit 13 is given as the set signal S to a bistable circuit SR1 at a first stage of the shift register 240. Moreover, the clear signal H_CLR outputted from the level shifter circuit 13 is also given as the reset signal R to a bistable circuit SRi at a final stage (i-th stage) of the shift register 240.

Figure 9:
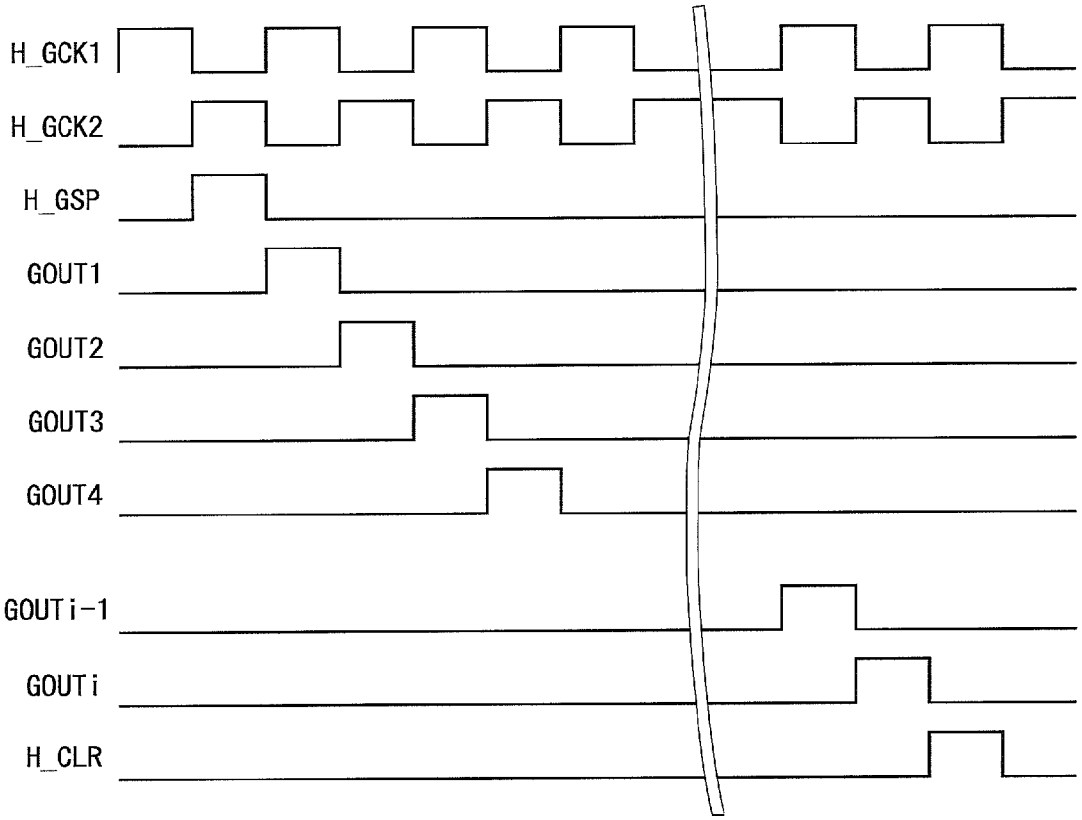
FIG. 9 is a signal waveform chart for explaining operations of the gate driver in the embodiment.

In such a configuration as described above, when a pulse of the gate start pulse signal H_GSP as the set signal S is given to the first stage of the shift register 240, then based on the first gate clock signal H_GCK1 and the second gate clock signal H_GCK2 (see FIG. 9), in each of which an ON duty is set at a value of approximately 50%, a pulse included in the gate start pulse signal H_GSP (this pulse is included in the state signal Q outputted from each stage) is sequentially transferred from the first stage to the i-th stage. Then, in response to this transfer of the pulse, the state signals Q outputted from the respective stages are sequentially turned to the high level. Then, the state signals Q outputted from the respective stages are given as the scanning signals GOUT1 to GOUTi to the respective gate bus lines GL1 to GLi. In such a way, the scanning signals GOUT1 to GOUTi, which are turned to the high level sequentially every predetermined period as shown in FIG. 9, are given to the gate bus lines GL1 to GLi in the display section 22.

Note that, in this embodiment, the respective stages of the shift registers 240 are provided so as to correspond to the respective rows of the pixel matrix in the one-to-one relationship; however, the present invention is not limited to this. For example, in a case of simultaneously driving a plurality of the gate bus lines, for example, in such a case where a drive system called "double gate drive" is adopted, one pulse is sometimes shared by the plurality of gate bus lines. In such a case, each stage of the shift register 240 is provided so as to correspond to a plurality of the rows of the pixel matrix. That is, a ratio of the number of stages of the shift register 240 and the number of gate bus lines may be one to one, or one to multiple.

4. Configuration and Operation of Bistable Circuit

Figure 10:
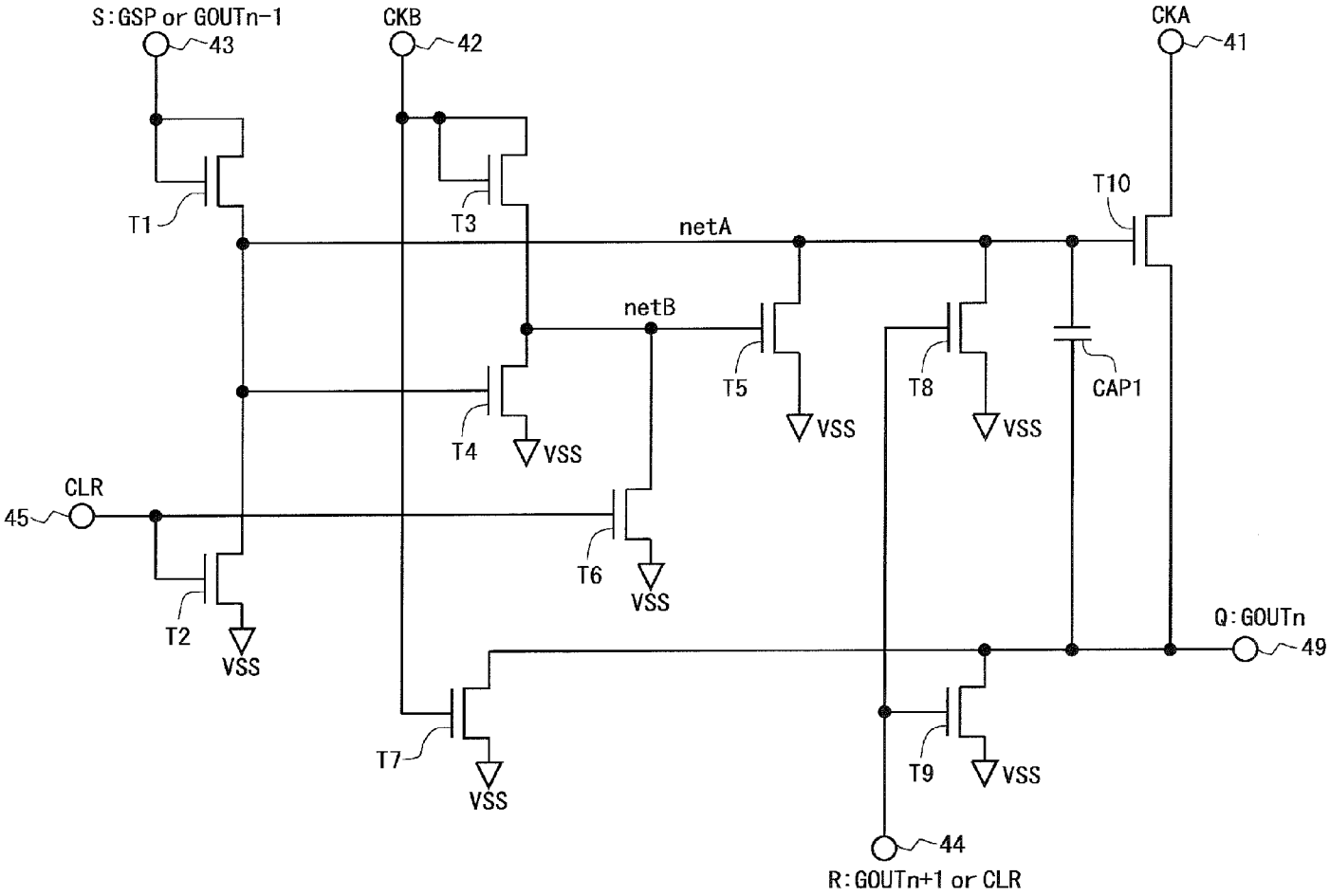
FIG. 10 is a circuit diagram showing a configuration of a bistable circuit included in the shift register in the embodiment.

FIG. 10 is a circuit diagram showing a configuration (a configuration of the n-th stage of the shift register 240) of the bistable circuit included in the shift register 240. As shown in FIG. 10, the bistable circuit SRn includes ten thin film transistors T1 to T10 and one capacitor CAP1. Note that, in FIG. 10, a reference character 41 is assigned to an input terminal for receiving the first clock CKA, a reference character 42 is assigned to an input terminal for receiving the second clock CKB, a reference character 43 is assigned to an input terminal for receiving the set signal S, a reference character 44 is assigned to an input terminal for receiving the reset signal R, a reference character 45 is assigned to an input terminal for receiving the clear signal CLR, and a reference character 49 is assigned to an out terminal for outputting the state signal Q.

A source terminal of the thin film transistor T1, a drain terminal of the thin film transistor T2, a drain terminal of the thin film transistor T5, a drain terminal of the thin film transistor T8, a gate terminal of the thin film transistor T10 and one end of the capacitor CAP1 are connected to one another. Note that a region (wire) in which they are connected to one another is referred to as a "netA" for the sake of convenience. A source terminal of the thin film transistor T3, a drain terminal of the thin film transistor T4, a gate terminal of the thin film transistor T5 and a drain terminal of the thin film transistor T6 are connected to one another. Note that a region (wire) in which they are connected to one another is referred to as a "netB" for the sake of convenience.

With regard to the thin film transistor T1, a gate terminal and a drain terminal thereof are connected to the input terminal 43 (that is, a diode connection is formed), and the source terminal thereof is connected to the netA. With regard to the thin film transistor T2, a gate terminal thereof is connected to the input terminal 45, the drain terminal thereof is connected to the netA, and a source terminal thereof is connected to a reference potential wire. With regard to the thin film transistor T3, a gate terminal and a drain terminal thereof are connected to the input terminal 42 (that is, a diode connection is formed), and the source terminal thereof is connected to the netB. With regard to the thin film transistor T4, a gate terminal thereof is connected to the netA, the drain terminal thereof is connected to the netB, and a source terminal thereof is connected to the reference potential wire. With regard to the thin film transistor T5, the gate terminal thereof is connected to the netB, the drain terminal thereof is connected to the netA, and a source terminal thereof is connected to the reference potential wire. With regard to the thin film transistor T6, a gate terminal thereof is connected to the input terminal 45, the drain terminal thereof is connected to the netB, and a source terminal thereof is connected to the reference potential wire. With regard to the thin film transistor T7, a gate terminal thereof is connected to the input terminal 42, a drain terminal thereof is connected to the output terminal 49, and a source terminal thereof is connected to the reference potential wire. With regard to the thin film transistor T8, a gate terminal thereof is connected to the input terminal 44, the drain terminal thereof is connected to the netA, and a source terminal thereof is connected to the reference potential wire. With regard to the thin film transistor T9, a gate terminal thereof is connected to the input terminal 44, a drain terminal thereof is connected to the output terminal 49, and a source terminal thereof is connected to the reference potential wire. With regard to the thin film transistor T10, the gate terminal thereof is connected to the netA, a drain terminal thereof is connected to the input terminal 41, and a source terminal thereof is connected to the output terminal 49. With regard to the capacitor CAP1, one end thereof is connected to the netA, and other end thereof is connected to the output terminal 49.

Note that, in this embodiment, a first node is realized by the netA, a second node is realized by the netB, and an output node is realized by the output terminal 49. Moreover, an output-node control switching element is realized by the thin film transistor T7, an output control switching element is realized by the thin film transistor T10, a first first-node control switching element is realized by the thin film transistor T2, a second first-node control switching element is realized by the thin film transistor T5, and a second-node control switching element is realized by the thin film transistor T6.

Figure 11:
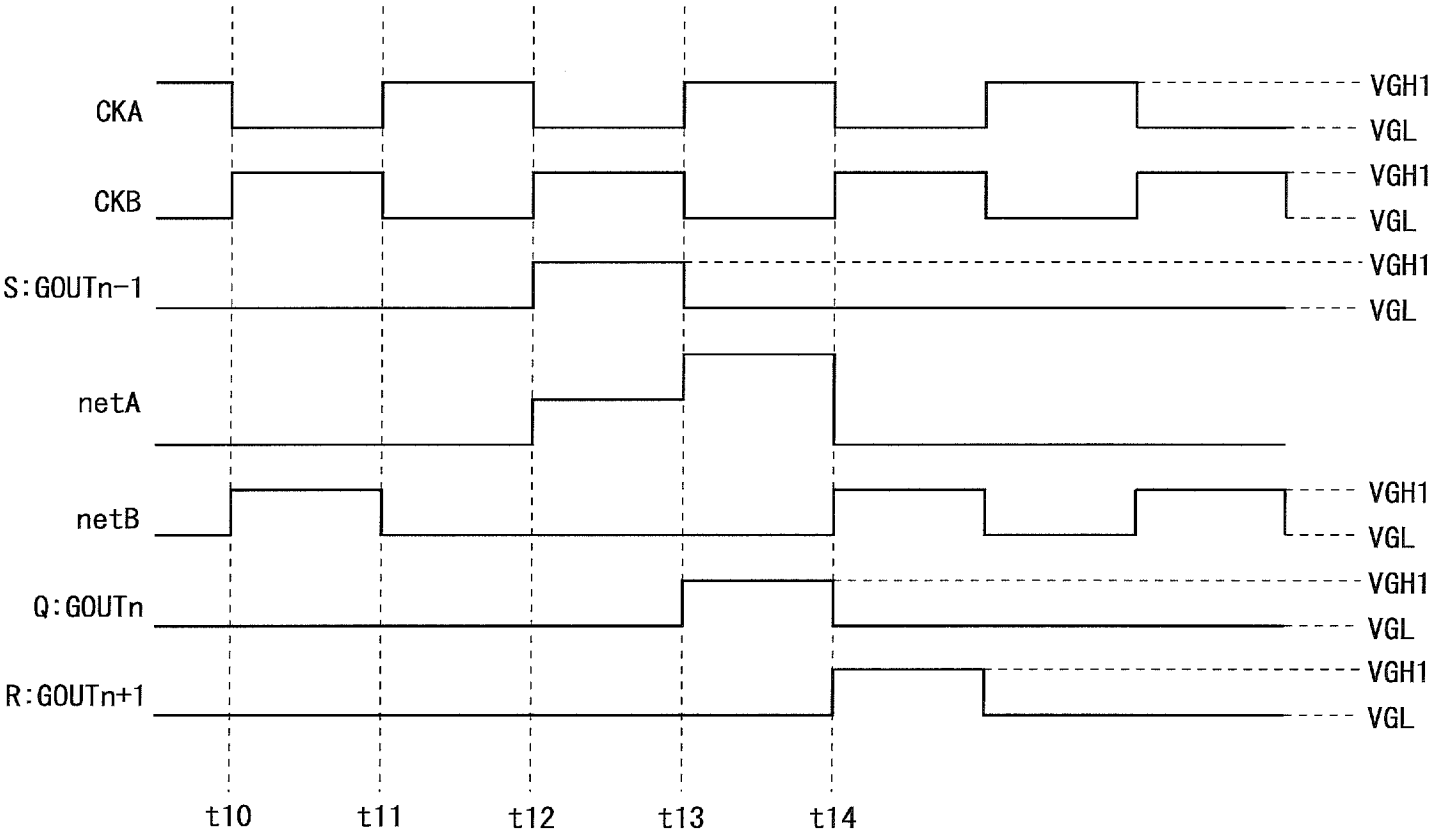
FIG. 11 is a signal waveform chart for explaining operations of the bistable circuit in the embodiment.

Next, with reference to FIG. 10 and FIG. 11, a description is made of operations of the bistable circuit SRn when the power supply is normally supplied from the outside. During a period while this liquid crystal display device is operating, the bistable circuit SRn is given the first clock CKA and the second clock CKB, in each of which the ON duty is set at the value of approximately 50%. Note that, with regard to the first clock CKA and the second clock CKB, high-level-side potentials thereof are set at the first gate ON potential VGH1 and low-level-side potentials thereof are set at the gate OFF potential VGL. Note that, the clear signal CLR is maintained at the low level during a period shown in FIG. 11, and accordingly, it is omitted in FIG. 11.

When reaching a point of time t10, and the second clock CKB is changed from the low level to the high level, the thin film transistor T3 is turned to the ON state since the diode connection is formed therein as shown in FIG. 10. At this time, the potential of the netA and the clear signal CLR are at the low level, and accordingly, the thin film transistors T4 and T6 are in the OFF state. Accordingly, at the point of time t10, the potential of the netB is changed from the low level to the high level. As a result, the thin film transistor T5 is turned to the ON state, and the potential of the netA is drawn into the reference potential VSS. Moreover, at the point of time t10, the thin film transistor T7 is also turned to the ON state. As a result, the potential of the state signal Q (the potential of the output terminal 49) is drawn into the reference potential VSS.

When reaching a point of time t11, the first clock CKA is changed from the low level to the high level. At this time, the potential of the netA is at the low level, and the thin film transistor T10 is in the OFF state, and accordingly, the potential of the state signal Q is maintained at the low level. Moreover, at the point of time t11, the potential of the netB is changed from the high level to the low level following the change of the second clock CKB from the high level to the low level.

When reaching a point of time t12, the set signal S is changed from the low level to the high level. The diode connection is formed in the thin film transistor T1 as shown in FIG. 10 and accordingly, the thin film transistor T1 is turned to the ON state by the set signal S turning to the high level. Accordingly, the capacitor CAP1 is charged, and the potential of the netA is changed from the low level to the high level. As a result, the thin film transistor T10 is turned to the ON state. Here, during a period from the point of time t12 to a point of time t13, the first clock CKA is at the low level. Therefore, the state signal Q is maintained at the low level during this period. Moreover, during this period, the thin film transistor T8 is maintained in the OFF state since the reset signal R is at the low level, and the thin film transistor T5 is maintained in the OFF state since the potential of the netB is at the low level. Therefore, the potential of the netA is not lowered during this period.

When reaching the point of time t13, the first clock CKA is changed from the low level to the high level. At this time, since the thin film transistor T10 is in the ON state, the potential of the output terminal 49 (the potential of the state signal Q) rises together with the rise of the potential of the input terminal 41. Here, the capacitor CAP1 is provided between the netA and the output terminal 49 as shown in FIG. 10, and accordingly, the potential of the netA also rises together with the rise of the potential of the output terminal 49 (that is, the netA is boot-strapped). Ideally, the potential of the netA rises to a double potential of the first gate ON potential VGH1 as the high-level side potential of the first clock CKA. As a result, a large voltage is applied to the gate terminal of the thin film transistor T10, and the potential of the state signal Q rises to the high-level side potential of the first clock CKA, that is, the potential level of the first gate ON potential VGH1. In such a way, the gate bus line connected to the output terminal 49 of this bistable circuit SRn is turned to the selected state. Note that, during a period from the point of time t13 to the point of time t14, the thin film transistor T7 is maintained in the OFF state since the second clock CKB is at the low level, and the thin film transistor T9 is maintained in the OFF state since the reset signal R is at the low level. Hence, the potential of the state signal Q is not lowered during this period. Moreover, during the period from the point of time t13 to the point of time t14, the thin film transistor T8 is maintained in the OFF state since the reset signal R is at the low level, and the thin film transistor T5 is maintained in the OFF state since the potential of the netB is at the low level. Therefore, the potential of the netA is not lowered during this period.

When reaching the point of time t14, the first clock CKA is changed from the high level to the low level. Accordingly, the potential of the output terminal 49, that is, the potential of the state signal Q is lowered together with the lowering of the potential of the input terminal 41. Therefore, the potential of the netA is also lowered through the capacitor CAP1. Moreover, at the point of time t14, the thin film transistors T3 and T7 are turned to the ON state by the second clock CKB changing from the low level to the high level, and the thin film transistors T8 and T9 are turned to the ON state by the reset signal R changing from the low level to the high level. Furthermore, the thin film transistor T3 is turned to the ON state, whereby the potential of the netB is changed from the low level to the high level, and the thin film transistor T5 is turned to the ON state. In such a way as described above, at the point of time t14, the potential of the netA is turned to the low level by the thin film transistors T5 and T8 turning to the ON state, and the potential of the state signal Q is turned to the low level by the thin film transistors T7 and T9 turning to the ON state.

Such operations as described above are performed in each of the bistable circuits in the shift register 240, whereby the scanning signals GOUT1 to GOUTi, which are turned to the high level sequentially every predetermined period as shown in FIG. 9, are given to the gate bus lines GL1 to Gli in the display section 22.

5. Operations at Time of Power Supply Shut-Off

Figure 1:
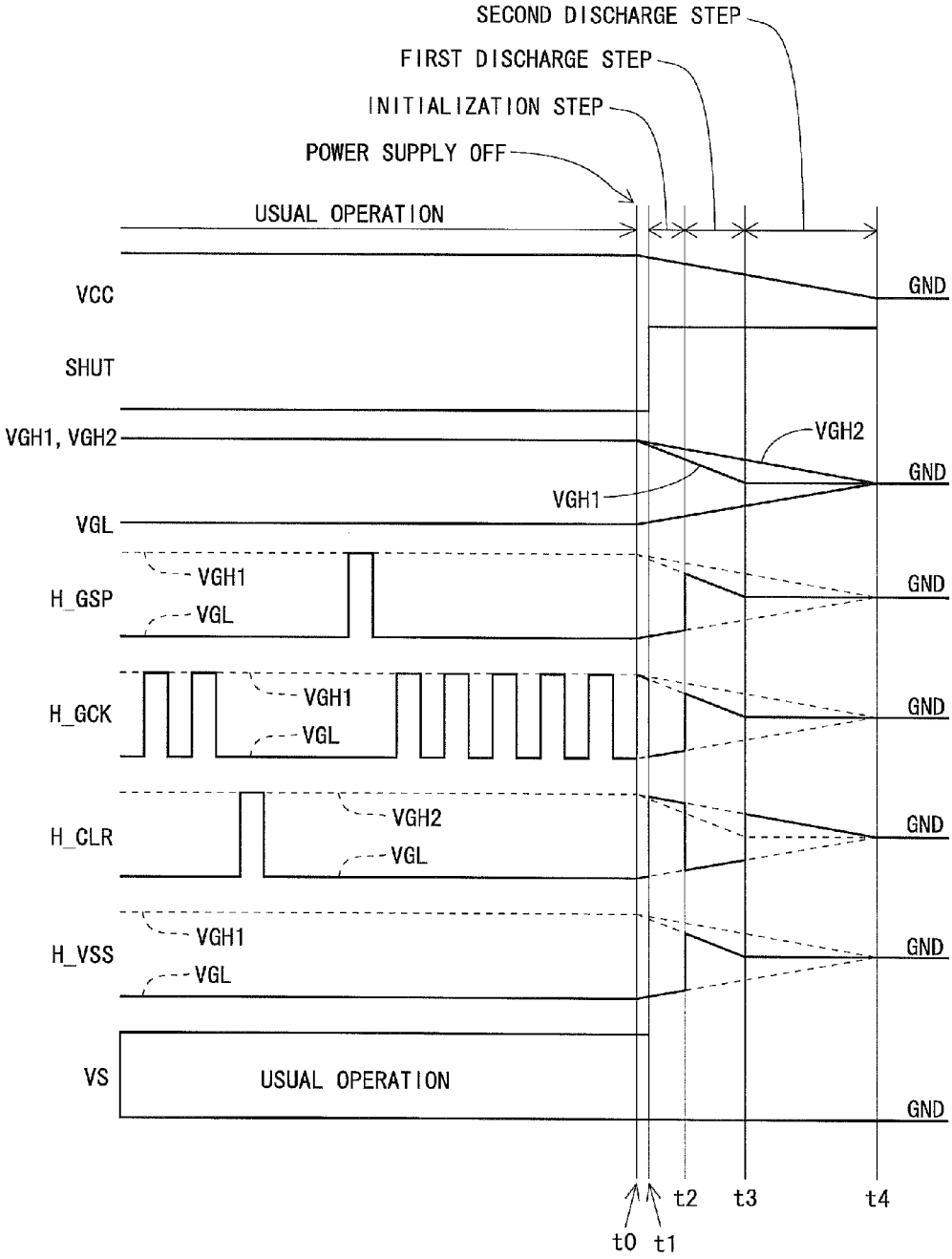
FIG. 1 is a signal waveform chart for explaining operations at a time of power supply shut-off in an active matrix-type liquid crystal display device according to an embodiment of the present invention.

Next, with reference to FIG. 1, FIG. 2, FIG. 10 and FIG. 12, a description is made of operations of the liquid crystal display device when the supply of the power supply from the outside is shut off. Note that a series of this processing is hereinafter referred to as a "power supply OFF sequence". FIG. 1 shows waveforms of the input power supply potential VCC, the power supply state signal SHUT, the gate ON potential (first gate ON potential VGH1 and second gate ON potential VGH2), the gate OFF potential VGL, the gate start pulse signal H_GSP, the gate clock signal H_GCK, the clear signal H_CLR, the reference potential H_VSS and the video signal potential (potential of the source bus line SL) VS. FIG. 12 shows potentials which the respective signals take at the time of the usual operation and at the time of the power supply shut-off. Note that the first gate clock signal H_GCK1 and the second gate clock signal H_GCK2 are only different from each other in phase during the usual operation, and are the same in waveform change on and after the point of time t1 after the power supply is OFF. Hence, FIG. 1 shows only one waveform as the gate clock signal H_GCK.

As mentioned above, the gate start pulse signal H_GSP is given as the set signal S to the bistable circuit on the first stage of the shift register 240, the gate clock signal H_GCK (first gate clock signal H_GCK1, second gate clock signal H_GCK2) is given as the first clock CKA and the second clock CKB to the respective bistable circuits, the clear signal H_CLR is given as the clear signal CLR to the respective bistable circuits, and is given as the reset signal R to the bistable circuit on the final stage of the shift register 240, and the reference potential H_VSS is given as the reference potential VSS to the respective bistable circuits.

As shown in FIG. 1, the power supply OFF sequence includes an initialization step, a first discharge step, and a second discharge step. The initialization step is a step for resetting (clearing) states of all of the bistable circuits which constitute the shift register 240. A first discharge step is a step for discharging the electric charges in the pixel formation portion. A second discharge step is a step for discharging the electric charges in the gate driver 24. Note that, in this description, it is assumed that the power supply is normally supplied before the point of time t0 and that the supply of the power supply is shut off at the point of time t0.

During a period (period before the point of time t0) while the power supply is being normally supplied, the power supply state signal SHUT is maintained at the low level. During this period, the potential of the gate start pulse signal H_GSP and the potential of the gate clock signal (first gate clock signal H_GCK1, second gate clock signal H_GCK2) are set at the first gate ON potential VGH1 or the gate OFF potential VGL, the potential of the clear signal H_CLR is set at the second gate ON potential VGH2 or the gate OFF potential VGL, and the reference potential H_VSS is set at the gate OFF potential VGL (see FIG. 1 and FIG. 12). Note that, during the period of the usual operation, the first gate ON potential VGH1 and the second gate ON potential VGH2 are set at the same potential level (for example, +20V).

When the supply of the power supply is shut off at the point of time t0, the input power supply potential VCC is gradually lowered to the ground potential GND. As a result, on and after the point of time t0, the first gate ON potential VGH1 and the second gate ON potential VGH2 are gradually lowered to the ground potential GND, and the gate OFF potential VGL gradually rises to the ground potential GND.

At the point of time t1 after the supply of the power supply is shut off at the point of time t0, the power supply OFF detection unit 17 changes the power supply state signal SHUT from the low level to the high level. When the power supply state signal SHUT is changed from the low level to the high level, the level shifter circuit 13 sets only the clear signal H_CLR among the GDM signals at the high-level side potential, and sets the signals other than the clear signal H_CLR at the low-level side potential. That is, during the period from the point of time t1 to the point of time t2, the potential of the clear signal H_CLR is set at the second gate ON potential VGH2, and the potential of the gate start pulse signal H_GSP, the potential of the gate clock signal H_GCK and the reference potential H_VSS are set at the gate OFF potential VGL (see FIG. 1 and FIG. 12). As grasped from FIG. 10, when the clear signal H_CLR is turned to the high level, the thin film transistors T2 and T6 are turned to the ON state in each of the bistable circuits. As a result, the potential of the netA and the potential of the netB are turned to the low level. In such a way as described above, in the initialization step (point of time t1 to point of time t2), the state of each of the bistable circuits is reset (cleared). Note that the video signal potential VS is equalized to the ground potential GND (0V) throughout the period on and after the point of time t1.

When reaching the point of time t2, the level shifter circuit 13 sets only the clear signal H_CLR among the GDM signals at the low-level side potential, and sets the signals other than the clear signal H_CLR at the high-level side potential. That is, during the period from the point of time t2 to the point of time t3, the potential of the clear signal H_CLR is set at the gate OFF potential VGL, and the potential of the gate start pulse signal H_GSP, the potential of the gate clock signal H_GCK and the reference potential H_VSS are set at the first gate ON potential VGH1 (see FIG. 1 and FIG. 12). Incidentally, at the point of time t2, the potential level of the first gate ON potential VGH1 is not sufficiently lowered. Hence, at the point of time t2, the gate start pulse signal H_GSP, the gate clock signal H_GCK and the reference potential H_VSS are turned to the high level. At this time, in each of the bistable circuits, the thin film transistor T7 is turned to the ON state in a state where the reference potential VSS is turned to the high level, and accordingly, the potential of the state signal Q is turned to the high level. As a result, all of the gate bus lines GL1 to GLi are turned to the selected state. Here, the video signal potential VS is at the ground potential GND during the period on and after the point of time t1 as shown in FIG. 1, and accordingly, the electric charges accumulated in the pixel capacitances in the respective pixel formation portions are discharged by all of the gate bus lines GL1 to GLi turning to the selected state. Moreover, during the period from the point of time t2 to the point of time t3, the potential of the gate clock signal H_GCK and the reference potential H_VSS are gradually lowered to the ground potential GND. As a result, the potential of the output terminal 49 (the potential of the state signal Q) of each of the bistable circuits is gradually lowered. That is, the electric charges on each of the gate bus lines are discharged. Moreover, since the potential of the output terminal 49 is gradually lowered, with regard to the potential of each of the pixels, potential variations owing to a kick-back voltage can be reduced to a level free from problems. In such a way as described above, in the first discharge step (from the point of time t2 to the point of time t3), the discharge of the electric charges is performed in all of the gate bus lines GL1 to GLi and all of the pixel formation portions in the display section 22.

As shown in FIG. 6, after the supply of the power supply is shut off, the potential level of the first gate ON potential VGH1 is lowered rapidly to the ground potential GND in comparison with the potential level of the second gate ON potential VGH2. Therefore, at the point of time t3, although the potential level of the second gate ON potential VGH2 is not sufficiently lowered, the potential level of the first gate ON potential VGH1 is lowered to the ground potential GND. Hence, the gate start pulse signal H_GSP, the gate clock signal H_GCK and the reference potential H_VSS, which are set at the high-level-side potential at the point of time t2, are lowered to the ground potential GND at the point of time t3.

At the point of time t3, the level shifter circuit 13 sets the clear signal H_CLR at the high-level-side potential. The potential level of the second gate ON potential VGH2 is not sufficiently lowered at the point of time t3 as mentioned above, and accordingly, the clear signal H_CLR is turned to the high level at the point of time t3. Therefore, the thin film transistors T2 and T6 are turned to the ON state in each of the bistable circuits. As a result, the potential of the netA and the potential of the netB are turned to the low level. In such a way, in the second discharge step (from the point of time t3 to the point of time t4), the discharge of the electric charges on floating nodes (netA and netB in each of the bistable circuits) in the shift register 240 that constitutes the gate driver 24 is performed.

Thereafter, at the point of time t4, the potential level of the second gate ON potential VGH2 is lowered to the ground potential GND. As a result, at the point of time t4, the clear signal H_CLR is also lowered to the ground potential GND. By the above, the power supply OFF sequence is ended.

Incidentally, the level shifter circuit 13 includes the timing generation logic unit 131 and the oscillator 132 as shown in FIG. 4 such that the potential of each of the GDM signals can be changed in the plurality of steps as shown in FIG. 1 in the power supply OFF sequence. In such a configuration, when the power supply state signal SHUT given from the power supply OFF detection unit 17 to the level shifter circuit 13 is changed from the low level to the high level, the timing generation logic unit 131 acquires start timing of each step by counting, by a counter, a base clock generated by the oscillator 132. Then, the timing generation logic unit 131 changes the potential of each of the GDM signals to a predetermined potential in accordance with timing thereof. In such a way, the gate start pulse signal H_GSP, the gate clock signal H_GCK (first gate clock signal H_GCK1, second gate clock signal H_GCK2), the clear signal H_CLR and the reference potential H_VSS, which have the waveforms as shown in FIG. 1, are generated. Note that the level shifter circuit 13 and the power supply OFF detection unit 17 may be stored in one LSI as shown by reference character 60 in FIG. 4.

6. Effects

According to this embodiment, in the liquid crystal display device including the IGZO-GDM, when the supply of the power supply is shut off, the power supply OFF sequence including three steps is performed. In the initialization step, only the clear signal H_CLR among the GDM signals is set at the high-level-side potential. Thus, the state of each bistable circuit is reset (cleared). In the first discharge step, only the clear signal H_CLR among the GDM signals is set at the low-level-side potential. That is, in the first discharge step, the gate start pulse signal H_GSP, the gate clock signal H_GCK and the reference potential H_VSS are turned to the high level. Thus, the thin film transistor T7 is turned to the ON state in the state where the reference potential VSS is turned to the high level, and accordingly, the potential of the state signal Q is turned to the high level, and the respective gate bus lines are turned to the selected state. At this time, the video signal potential VS is at the ground potential GND, and accordingly, the electric charges accumulated in the pixel capacitances in the respective pixel formation portions are discharged. Moreover, the gate start pulse signal H_GSP, the gate clock signal H_GCK and the reference potential H_VSS are gradually lowered, and accordingly, the electric charges on each of the gate bus lines are also discharged. Moreover, since the potential is gradually lowered, with regard to the potential of each of the pixels, the potential variations owing to the kick-back voltage can be reduced to the level free from problems. In the second discharge step, the clear signal H_CLR is set at the high-level-side potential. Thus, the electric charges on the floating nodes (netA and netB) in each of the bistable circuits are discharged. Incidentally, in this embodiment, as the gate ON potential, there are generated: the first gate ON potential VGH1 in which the potential level is lowered relatively rapidly at the time of the power supply shut-off; and the second gate ON potential VGH2 in which the potential level is lowered relatively gently at the time of the power supply shut-off. Then, the first gate ON potential VGH1 is used as the high-level-side potentials of the gate start pulse signal H_GSP, the gate clock signal H_GCK and the reference potential H_VSS among the GDM signals, and the second gate ON potential VGH2 is used as the high-level-side potential of the clear signal H_CLR among the GDM signals. Therefore, such a configuration is made possible, in which the electric charges on each of the gate bus lines are sufficiently discharged until the second discharge step is started, and moreover, only the clear signal H_CLR among the GDM signals is maintained at the high level in the second discharge step. By the operations described above, in the liquid crystal display device including the IGZO-GDM, in the event where the supply of the power supply is shut off, the electric charges in the pixel formation portions, the electric charges on the gate bus lines, and the electric charges on the floating nodes (netA and netB in each of the bistable circuits) in the shift register 240 are sequentially discharged. As described above, the liquid crystal display device including the IGZO-GDM, which is capable of rapidly removing the residual electric charges in the panel when the power supply is turned off, is realized. As a result, in the liquid crystal display device including the IGZO-GDM, an occurrence of display defect/malfunction that may be caused by the presence of the residual electric charges in the panel is suppressed.

7. Modification Examples and the Like

Figure 13:
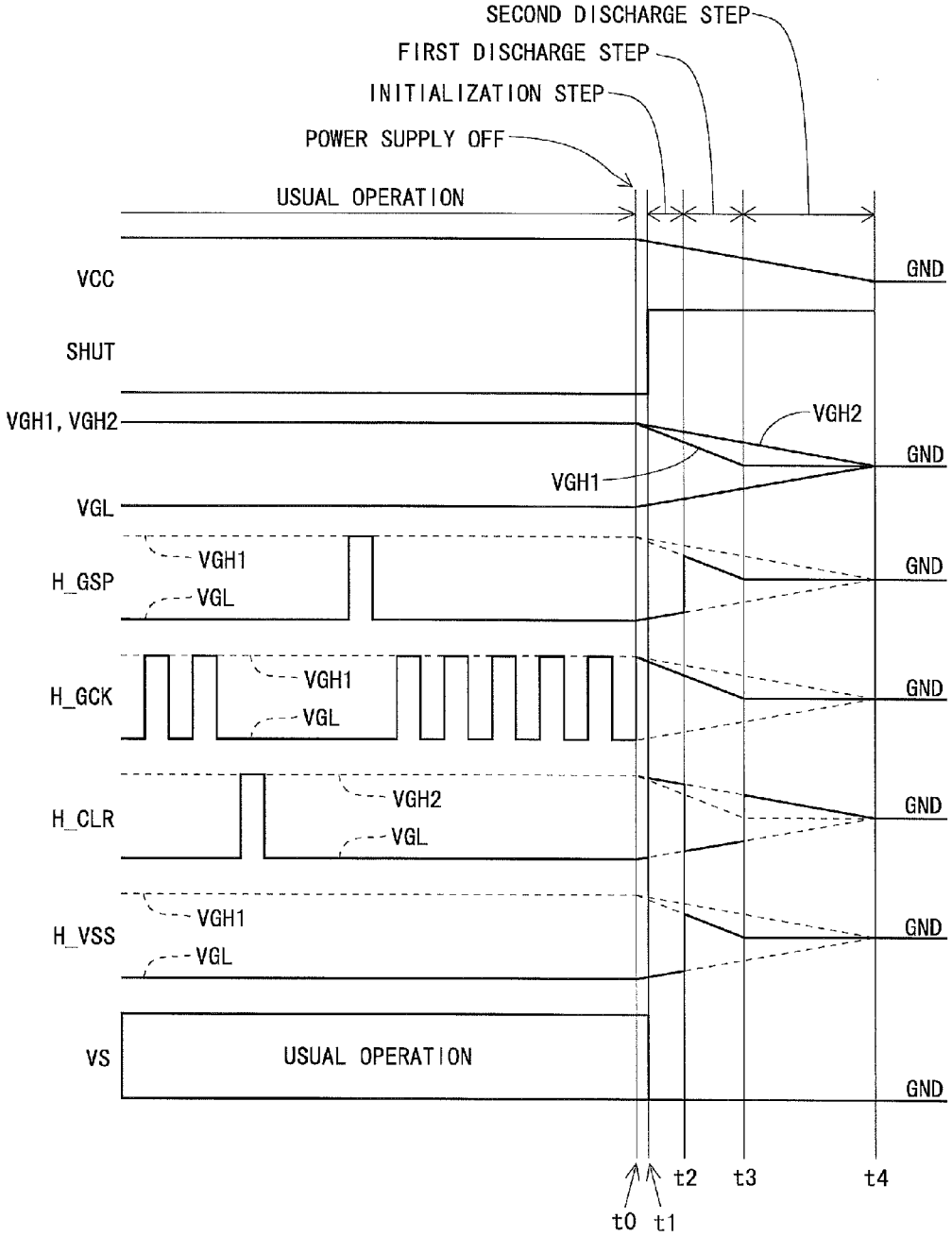
FIG. 13 is a signal waveform chart for explaining operations at a time of power supply shut-off in a modification example of the embodiment.
Figure 14:
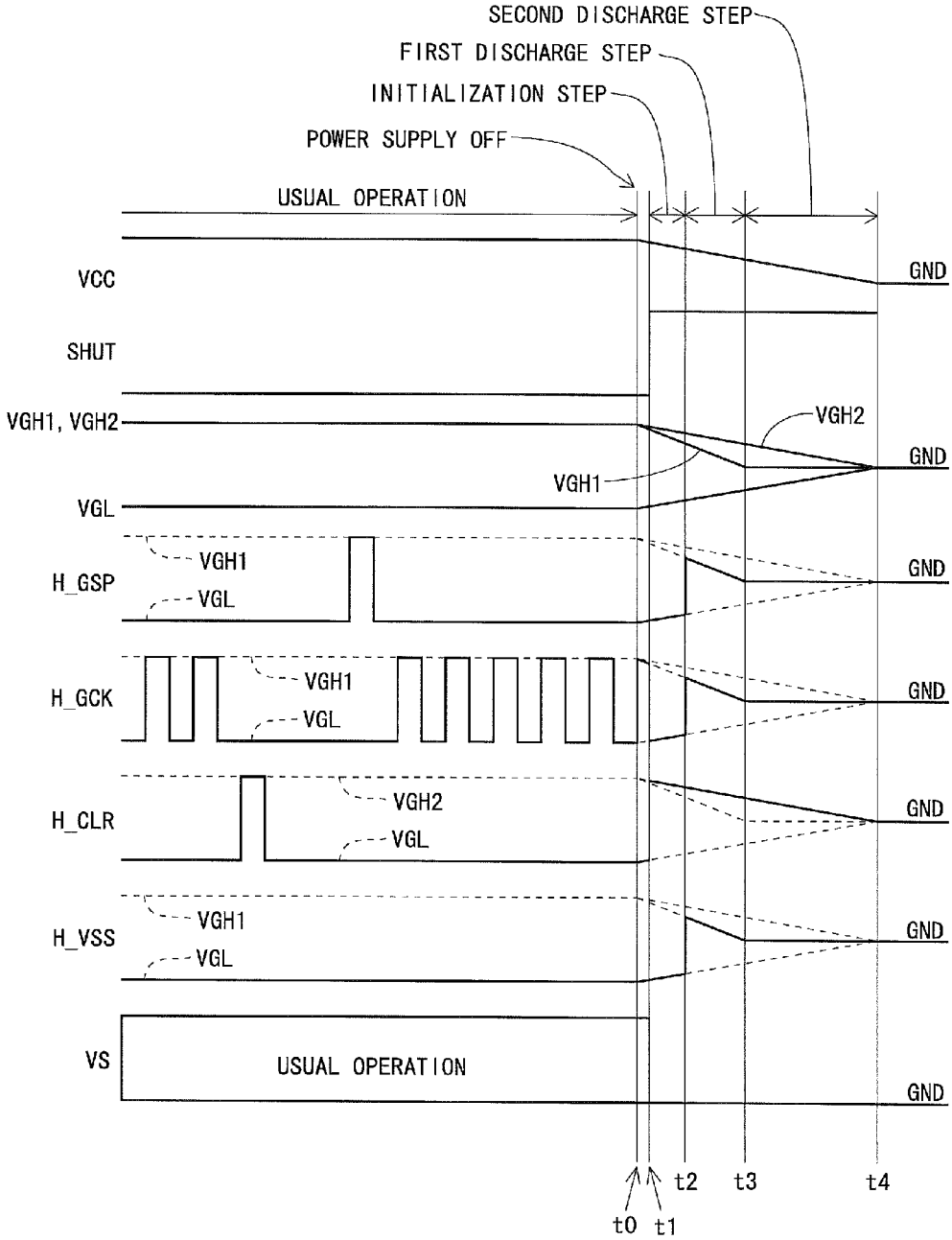
FIG. 14 is a signal waveform chart for explaining operations at a time of power supply shut-off in another modification example of the embodiment.

In the above-described embodiment, the gate clock signal H_GCK is set at the low-level-side potential in the event of the initialization step. However, the present invention is not limited to this. The gate clock signal H_GCK may be set at the high-level-side potential in the event of the initialization step (see FIG. 13). Also in this case, in the initialization step, the thin film transistors T2 and T6 are turned to the ON state in each of the bistable circuits by the clear signal H_CLR turning to the high level, and accordingly, the potential of the netA and the potential of the netB are turned to the low level. Moreover, in the above-described embodiment, the clear signal H_CLR is set at the low-level-side potential in the event of the first discharge step. However, the present invention is not limited to this. The clear signal H_CLR may be set at the high-level-side potential in the event of the first discharge step (see FIG. 14). Also in this case, in the first discharge step, the thin film transistor T7 is turned to the ON state in the state where the reference potential VSS is turned to the high level in each of the bistable circuits, and accordingly, the potential of the state signal Q is turned to the high level, and each of the gate bus lines is turned to the selected state.

Moreover, in the above-described embodiment, the power supply OFF sequence includes the initialization step, the first discharge step, and the second discharge step. However, the present invention is not limited to this. The power supply OFF sequence may include the first discharge step and the second discharge step. However, such a configuration including the initialization step can remove the residual electric charges in the panel more surely.

Moreover, the description has been made of the above-described embodiment by taking as an example the liquid crystal display device including the IGZO-GDM. However, the present invention is not limited to this. The present invention can also be applied to a liquid crystal display device including a monolithic gate driver other than the IGZO-GDM (for example, a monolithic gate driver in which an a-Si TFT is adopted for the semiconductor layer of the thin film transistor).

Moreover, in the above-described embodiment, the power supply OFF sequence is described as a sequence when the supply of the power supply from the outside is shut off. However, for example, the power supply OFF sequence as mentioned above may be appropriately performed as a discharge sequence at the time when a mode of the display device is shifted (that is, at the time when the mode is shifted between a display mode and a sleep mode), or as a discharge sequence by input of a command.

DESCRIPTION OF REFERENCE CHARACTERS

11: TIMING CONTROLLER
13: LEVEL SHIFTER CIRCUIT
15: POWER SUPPLY CIRCUIT
17: POWER SUPPLY OFF DETECTION UNIT
20: LIQUID CRYSTAL PANEL
22: DISPLAY SECTION
24: GATE DRIVER (SCANNING SIGNAL LINE DRIVE CIRCUIT)
32: SOURCE DRIVER (VIDEO SIGNAL LINE DRIVE CIRCUIT)
220: THIN FILM TRANSISTOR (IN PIXEL FORMATION PORTION)
240: SHIFT REGISTER
VCC: INPUT POWER SUPPLY POTENTIAL
SHUT: POWER SUPPLY STATE SIGNAL
VGH: GATE ON POTENTIAL
VGH1: FIRST GATE ON POTENTIAL
VGH2: SECOND GATE ON POTENTIAL
VGL: GATE OFF POTENTIAL
L_GCK: GATE CLOCK SIGNAL
H_GCK1: FIRST GATE CLOCK SIGNAL
H_GCK2: SECOND GATE CLOCK SIGNAL
L_GSP, H_GSP: GATE START PULSE SIGNAL
L_CLR, H_CLR, CLR: CLEAR SIGNAL
L_VSS, H_VSS, VSS: REFERENCE POTENTIAL
T1 to T10: THIN FILM TRANSISTOR (IN BISTABLE CIRCUIT)
CKA: FIRST CLOCK
CKB: SECOND CLOCK
S: SET SIGNAL
R: RESET SIGNAL
Q: STATE SIGNAL
GOUT1 to GOUTi: SCANNING SIGNAL

The invention claimed is:

1. A liquid crystal display device comprising:
a substrate that constitutes a display panel;
a plurality of video signal lines which transmit video signals;
a plurality of scanning signal lines which intersect the plurality of video signal lines;
a plurality of pixel formation portions arranged in a matrix so as to correspond to the plurality of video signal lines and the plurality of scanning signal lines;
a scanning signal line drive circuit that includes a shift register made of a plurality of bistable circuits which are provided so as to correspond to the plurality of scanning signal lines and sequentially output pulses based on a clock signal, and that selectively drives the plurality of scanning signal lines based on the pulses outputted from the shift register;
a power supply circuit that generates, based on a power supply given from an outside, a scanning signal line selection potential as a potential for turning the scanning signal lines to a selected state, and a scanning signal line non-selection potential as a potential for turning the scanning signal lines to a non-selected state;
a drive control unit that generates the clock signal, a clear signal for initializing states of the plurality of bistable circuits, and a reference potential as a potential serving as a reference of operations of the plurality of bistable circuits, and controls an operation of the scanning signal line drive circuit; and
a power supply state detection unit that gives a predetermined power supply OFF signal to the drive control unit upon detecting an OFF state of the power supply,
wherein the plurality of video signal lines, the plurality of scanning signal lines, the plurality of pixel formation portions, and the scanning signal line drive circuit are formed on the substrate,
each of the bistable circuits includes:
an output node connected to the scanning signal line;
an output control switching element in which a second electrode is given the clock signal, and a third electrode is connected to the output node;
a first node connected to a first electrode of the output control switching element; and
a first first-node control switching element in which a first electrode is given the clear signal, a second electrode is connected to the first node, and a third electrode is given the reference potential,
the power supply circuit generates, as the scanning signal line selection potential, a first scanning signal line selection potential and a second scanning signal line selection potential, which are different from each other in change state of a potential level when the power supply is turned to an OFF state,
the drive control unit:
sets a potential of the clock signal at the first scanning signal line selection potential or the scanning signal line non-selection potential;
sets a potential of the clear signal at the second scanning signal line selection potential or the scanning signal line non-selection potential;
sets the reference potential at the first scanning signal line selection potential or the scanning signal line non-selection potential; and
upon receiving the power supply OFF signal, sequentially performs first discharge processing for setting the potential of the clock signal and the reference potential at the first scanning signal line selection potential, and second discharge processing for setting the potential of the clear signal at the second scanning signal line selection potential, and
at a point of time when the second discharge processing is started, the first scanning signal line selection potential is equalized to a ground potential, and the second scanning signal line selection potential is maintained at a potential level at which the switching elements included in each of the bistable circuits are turned to an ON state.

2. The liquid crystal display device according to claim 1, wherein each of the bistable circuits further includes:
a second first-node control switching element in which a second electrode is connected to the first node, and a third electrode is given the reference potential;
a second node connected to a first electrode of the second first-node control switching element; and
a second-node control switching element in which a first electrode is given the clear signal, a second electrode is connected to the second node, and a third electrode is given the reference potential.

3. The liquid crystal display device according to claim 1, wherein, when the power supply is turned to the OFF state, the first scanning signal line selection potential is changed gradually with a constant gradient from a potential at a point of time when the power supply is turned to the OFF state to the ground potential.

4. The liquid crystal display device according to claim 3, wherein the power supply circuit includes a first scanning signal line selection potential generation line for generating the first scanning signal line selection potential based on a predetermined potential generated by the power supply, and a second scanning signal line selection potential generation line for generating the second scanning signal line selection potential based on the predetermined potential, the first scanning signal line selection potential generation line being connected to a first capacitor and a first resistor, the second scanning signal line selection potential generation line being connected to a second capacitor and a second resistor, and a discharge time constant determined by the second capacitor and the second resistor is larger than a discharge time constant determined by the first capacitor and the first resistor.

5. The liquid crystal display device according to claim 1, wherein the drive control unit sets the potential of the clear signal at the scanning signal line non-selection potential in an event of the first discharge processing.

6. The liquid crystal display device according to claim 1, wherein, when the drive control unit receives the power supply OFF signal, the drive control unit performs initialization processing for setting the potential of the clear signal at the second scanning signal line selection potential and setting the reference potential at the scanning signal line non-selection potential, before the first discharge processing.

7. The liquid crystal display device according to claim 6, wherein the drive control unit sets the potential of the clock signal at the scanning signal line non-selection potential in an event of the initialization processing.

8. The liquid crystal display device according to claim 1, wherein each of the bistable circuits further includes an output-node control switching element, in which a first electrode is given the clock signal, a second electrode is connected to the output node, and a third electrode is given the reference potential.

9. The liquid crystal display device according to claim 1, wherein the switching elements included in each of the bistable circuits are thin film transistors made of an oxide semiconductor.

10. The liquid crystal display device according to claim 9, wherein the oxide semiconductor is indium gallium zinc oxide (IGZO).

11. A driving method of a liquid crystal display device including: a substrate that constitutes a display panel; a plurality of video signal lines which transmit video signals; a plurality of scanning signal lines which intersect the plurality of video signal lines; a plurality of pixel formation portions arranged in a matrix so as to correspond to the plurality of video signal lines and the plurality of scanning signal lines; a scanning signal line drive circuit that drives the plurality of scanning signal lines; a power supply circuit that generates, based on a power supply given from an outside, a scanning signal line selection potential as a potential for turning the scanning signal lines to a selected state, and a scanning signal line non-selection potential as a potential for turning the scanning signal lines to a non-selected state; and a drive control unit that controls an operation of the scanning signal line drive circuit, the driving method comprising:

a power supply state detection step of detecting ON/OFF states of the power supply given from the outside; and an electric charge discharging step of discharging electric changes in the display panel, the electric charge discharging step being executed when the OFF state of the power supply is detected in the power supply state detection step, wherein the scanning signal line drive circuit includes a shift register made of a plurality of bistable circuits which are provided so as to correspond to the plurality of scanning signal lines and sequentially output pulses based on a clock signal, the drive control unit generates the clock signal, a clear signal for initializing states of the plurality of bistable circuits, and a reference potential as a potential serving as a reference of operations of the plurality of bistable circuits, each of the bistable circuits includes:

an output node connected to the scanning signal line;

an output-control switching element in which a second electrode is given the clock signal, and a third electrode is connected to the output node;

a first node connected to a first electrode of the output-control switching element; and a first first-node control switching element in which a first electrode is given the clear signal, a second electrode is connected to the first node, and a third electrode is given the reference potential, the power supply circuit generates, as the scanning signal line selection potential, a first scanning signal line selection potential and a second scanning signal line selection potential, which are different from each other in change state of a potential level when the power supply is turned to the OFF state, the electric charge discharging step includes:

a first discharge step of setting the potential of the clock signal and the reference potential at the first scanning signal line selection potential; and a second discharge step of setting the potential of the clear signal at the second scanning signal line selection potential, and at a point of time when the second discharge step is started, the first scanning signal line selection potential is equalized to a ground potential, and the second scanning signal line selection potential is maintained at a potential level at which the switching elements included in each of the bistable circuits are turned to an ON state.

12. The driving method according to claim 11, wherein each of the bistable circuits further includes:

a second first-node control switching element in which a second electrode is connected to the first node, and a third electrode is given the reference potential;

a second node connected to a first electrode of the second first-node control switching element; and a second-node control switching element in which a first electrode is given the clear signal, a second electrode is connected to the second node, and a third electrode is given the reference potential.

13. The driving method according to claim 11, wherein, when the power supply is turned to the OFF state, the first scanning signal line selection potential is changed gradually with a constant gradient from a potential at a point of time when the power supply is turned to the OFF state to the ground potential.

14. The driving method according to claim 13, wherein the power supply circuit includes a first scanning signal line selection potential generation line for generating the first scanning signal line selection potential based on a predetermined potential generated by the power supply, and a second scanning signal line selection potential generation line for generating the second scanning signal line selection potential based on the predetermined potential, the first scanning signal line selection potential generation line being connected to a first capacitor and a first resistor, the second scanning signal line selection potential generation line being connected to a second capacitor and a second resistor, and a discharge time constant determined by the second capacitor and the second resistor is larger than a discharge time constant determined by the first capacitor and the first resistor.

15. The driving method according to claim 11, wherein the potential of the clear signal is set at the scanning signal line non-selection potential in the first discharge step.

16. The driving method according to claim 11, wherein the electric charge discharging step further includes, as a step performed before the first discharge step, an initialization step of setting the potential of the clear signal at the second scanning signal line selection potential and setting the reference potential at the scanning signal line non-selection potential.

17. The driving method according to claim 16, wherein the potential of the clock signal is set at the scanning signal line non-selection potential in the initialization step.

18. The driving method according to claim 11, wherein each of the bistable circuits further includes an output-node control switching element in which a first electrode is given the clock signal, a second electrode is connected to the output node, and a third electrode is given the reference potential.

19. The driving method according to claim 11, wherein the switching elements included in each of the bistable circuits are thin film transistors made of an oxide semiconductor.

20. The driving method according to claim 19, wherein the oxide semiconductor is indium gallium zinc oxide (IGZO).

* * * * *